US008692753B2

(12) United States Patent
Sekine

(10) Patent No.: US 8,692,753 B2
(45) Date of Patent: Apr. 8, 2014

(54) LIQUID CRYSTAL DISPLAY DEVICE AND DRIVING METHOD OF THE SAME

(75) Inventor: Hiroyuki Sekine, Kawasaki (JP)

(73) Assignee: NLT Technologies, Ltd., Kanagawa (JP)

( * ) Notice: Subject to any disclaimer, the term of this patent is extended or adjusted under 35 U.S.C. 154(b) by 1335 days.

(21) Appl. No.: 12/483,701

(22) Filed: Jun. 12, 2009

(65) Prior Publication Data

US 2010/0002163 A1 Jan. 7, 2010

(30) Foreign Application Priority Data

Jul. 3, 2008 (JP) ..... 2008-174283
Apr. 28, 2009 (JP) ..... 2009-110162
Jun. 3, 2009 (JP) ..... 2009-134289

(51) Int. Cl.
*G09G 3/36* (2006.01)

(52) U.S. Cl.
USPC ..... 345/87; 345/92; 349/48

(58) Field of Classification Search
USPC ..... 345/87
See application file for complete search history.

(56) References Cited

U.S. PATENT DOCUMENTS 6,057,897 A * 5/2000 Ichikawa et al. ..... 349/48
2002/0190937 A1* 12/2002 Song ..... 345/87
2006/0145988 A1* 7/2006 Hsieh et al. ..... 345/92

FOREIGN PATENT DOCUMENTS

JP 09-127917 A 5/1997

* cited by examiner

*Primary Examiner* — Sumati Lefkowitz
*Assistant Examiner* — Jose Soto Lopez
(74) *Attorney, Agent, or Firm* — Sughrue Mion, PLLC

(57) ABSTRACT

To provide a liquid crystal display device capable of improving a moving picture characteristic at a low cost by achieving high luminance of the liquid crystal display device which performs quasi-impulse drive. In the liquid crystal display device of the present invention, a first switching device constituting each pixel has a control terminal connected to a gate line, another control terminal connected to another gate line, and becomes electrically conductive when one of the control terminals is low level while the other is high level. A second switching device has a control terminal connected to the gate line and a control terminal connected to the other gate line. A pixel capacitance and a storage capacitance are connected to data lines via the first switching device, and connected to a black signal supplying wiring via the second switching device. The black signal supplying wiring is common to all the pixels.

11 Claims, 29 Drawing Sheets

LIQUID CRYSTAL DISPLAY DEVICE AND DRIVING METHOD OF THE SAME

CROSS-REFERENCE TO RELATED APPLICATIONS

This application is based upon and claims the benefit of priority from Japanese patent application No. 2008-174283, filed on Jul. 3, 2008, Japanese patent application No. 2009-110162, filed on Apr. 28, 2009, and Japanese patent application No. 2009-134289, filed on Jun. 3, 2009 the disclosure of which is incorporated herein in its entirety by reference.

BACKGROUND OF THE INVENTION

1. Field of the Invention

The present invention relates to a liquid crystal display device. More specifically, the present invention relates to an active-matrix type liquid crystal display device and a driving method of the same.

2. Description of the Related Art

Among the liquid crystal display devices, particularly the active-matrix type liquid crystal display device having TFT (Thin Film Transistor), which is an active device, provided at each pixel has been widely used for a various kinds of devices from portable devices such as portable telephones to thin-type television sets, since it is capable of providing a high image quality with a low power consumption. Comparing a television set using the liquid crystal display device with a CRT (Cathode Ray Tube) type television set, the television set using the liquid crystal display device has many advantages, e.g., capable of providing a large area with a thin model, capable of achieving high definition, and capable of being driven with a low power consumption. However, it is pointed out that contours of images become blurred when displaying moving pictures.

While there are some reasons for the blurring of the contours when displaying moving pictures, it is considered substantially because the liquid crystal display device is a hold-type display device. The hold-type is a device which employs a display method with which luminance of each pixel is held until it is rewritten to a signal of a next frame. In the meantime, CRT exhibits such a characteristic that, when an electron beam is irradiated to a phosphor surface, a phosphor in that area illuminates and the luminance decreases rapidly thereafter at a time constant. This is called an impulse type in contrast with the hold type.

In a case of the hold-type display device, signals of a previous frame are continuously displayed until signals of a next frame are written. Thus, human beings recognize the signals of the previous and following frames integrally in terms of time in a contour part of a moving image, so that the human beings perceive it as having a blurred image. There have been mainly two approaches made for overcoming the issues of the hold type. One is to increase the frame frequency, and generate and display a frame image (that is not originally present) between a previous frame and a following frame. This is called a double-speed drive, since display is conducted at a speed that is twice as fast as a normal speed. With this, change of the images between the flames is decreased, and the blur generated at the contours of images can be suppressed. The other is a method which changes a driving method so as to obtain a display characteristic close to that of the impulse type, which is a technique called a quasi-impulse drive. Comparing both methods, the double-speed drive has an issue of an increase in the cost for circuit components, since it uses a sophisticated signal processing technique such as analysis of video signals to be displayed, generation of intermediate images, etc. The other quasi-impulse drive does not require the sophisticated signal processing. However, it is necessary to have such a characteristic that is capable of writing video signals at a high speed as in that of the double-speed drive for the liquid crystal display device.

The liquid crystal display device which performs such quasi-impulse drive will be described by referring to the accompanying drawings. FIG. 27 is a block diagram and a circuit diagram showing a structural example of the liquid crystal display device which performs such quasi-impulse drive. FIG. 28 is an enlarged circuit diagram which shows a single pixel taken out from FIG. 27. Hereinafter, explanations will be provided by referring to FIG. 27 and FIG. 28. Not only the pixel which is disposed between a gate line G1 and a gate line G2 and connected to a data line D4, but also all the other pixels are referred to as pixels 910.

This liquid crystal display device is configured with a pixel matrix 901, a data driver circuit 902 for driving data lines D1-D4, and a gate driver circuit 903 for driving gate lines G1-G4. In the pixel matrix 901, the pixel 910 configured with a TFT 911 as a pixel switch, a liquid crystal capacitance Clc, and a storage capacitance Cst is arranged in matrix at each intersection point between the data lines D1-D4 and the gate lines G1-G4 which are arranged in matrix. The liquid crystal capacitance Clc is a capacitance configured with a pixel electrode 912 and a common electrode 913 disposed in each pixel 910 and a liquid crystal substance 914 disposed therebetween. The storage capacitance Cst is a capacitance that is configured with two electrodes, i.e., an electrode 915 whose one end is electrically connected to the pixel electrode 912 and an electrode 916 whose other end is connected to a wiring VCS. A voltage is applied to the wiring VCS from a constant potential power source.

Operations of the liquid crystal display device at the time of performing the quasi-impulse drive will be described by referring to a timing chart of FIG. 29. A frame period Tv corresponding to a cycle at which video signals of one screen is inputted to the liquid crystal display device from outside is divided at least into two periods Td and Tb. The period Td is a period where the video signals are written to the liquid crystal display device, and the period Tb is a period where black signals are written to the liquid crystal display device.

Next, operations in the period Td will be described. The gate driver circuit 903 performs an operation of selecting each of the gate lines G1-G4 sequentially in the period Td. For example, in a period where the gate driver circuit 903 selects the gate line G1, it is possible to write the video signals to all the pixels 910 that are connected to the gate line G1 when the data driver circuit 902 writes the signals corresponding to the video signals to each of the data lines D1-D4. Through performing this operation for all the gate lines G1-G4, the video signals for the one screen can be written to the liquid crystal display device.

The gate driver circuit 903 also performs an operation of selecting each of the gate lines G1-G4 sequentially in the period Tb. For example, in a period where the gate driver circuit 903 selects the gate line G1, it is possible to write the black signals to all the pixels 910 that are connected to the gate line G1 when the data driver circuit 902 writes the black signal to each of the data lines D1-D4. Through performing this operation for all the gate lines G1-G4, the black signals can be written to all the pixels 910 of the liquid crystal display device.

In FIG. 29, a voltage Vlc1,1 shows a voltage of the pixel 910 that is connected to the data line D1, which is disposed between the gate line G1 and the gate line G2. Similarly, a voltage Vlc1,2 shows a voltage of the pixel 910 that is connected to the data line D1, which is disposed between the gate line G2 and the gate line G3.

Through such operations, the liquid crystal display device displays the video signals in the period Td that is a first half of one-frame period, and displays black in the period Tb that is a latter half. When a response speed of the liquid crystal display device is sufficient, each of the pixels 910 of the liquid crystal display device changes to the luminance that corresponds to the written signal when the video signal is written. When the black signal is written thereafter, the luminance decreases regardless of the video signal, and black is displayed. That is, it exhibits a display characteristic that is close to the impulse type such as CRT. Therefore, it is possible to decrease blurring generated when displaying a moving picture, which is attributed to being the hold type.

However, in order to achieve the quasi-impulse drive, it is necessary to write the video signals to the liquid crystal display device at a high speed in a shorter period than the frame period and to write the black signals in a remaining period. Thus, it is necessary to operate the gate driver circuit and the data driver circuit at a high speed. Further, the video signals are written to the liquid crystal display device with a frequency that is different from the frequency of the video signals inputted to the liquid crystal display device, so that it is necessary to provide a frame memory for converting the frequency. As described, since the gate driver circuit and the data driver circuit capable of high-speed actions as well as the frame memory are required, there is such an issue that the manufacturing cost for the liquid crystal display device is increased.

An example of the liquid crystal display device which overcomes the above-described issue and achieves the quasi-impulse drive is depicted in Japanese Unexamined Patent Publication 9-127917 (pp. 3-4, FIG. 1: Patent Document 1). The liquid crystal display device depicted in Patent Document 1 is structured in such a manner that: pixels each having two TFTs are arranged in matrix at intersection points of signal lines (data lines) and scanning lines (gate lines) arranged in matrix; a black signal supplying line is disposed in parallel to each signal line (data line); a black signal supply command signal wiring is disposed in parallel to each scanning line (gate line); a gate terminal of one of the two TFTs disposed in each pixel is connected to the scanning line (gate line), and a drain terminal thereof is connected to the data line; a gate terminal of the other TFT is connected to the black signal supply command signal wiring, and a drain terminal thereof is connected to the black signal supplying wiring; and the both source terminals of the two TFTs are connected to the liquid crystal capacitance.

Next, operations will be described. Each scanning line is scanned sequentially by the gate driver in one-frame period. When the source driver supplies the video signal to each signal line by corresponding to the scanning actions, the video signal is sequentially written to the liquid crystal display device by a row unit according to the scanning. The black signal supply command signal wiring is scanned by another gate driver at a time that is shifted from the timing at which the each of the above-described scanning lines is scanned. Upon this, the potential of the black signal supplying wiring is sequentially written to the liquid crystal display device by a row unit.

As described, with this liquid crystal display device, the video signals and the black signals can be written individually at different timings by two control lines (the scanning line and the black signal supply command signal wiring) Thus, it is possible to write the video signals and the black signals with the same frequency as that of the video signals supplied to the liquid crystal display device. Therefore, the gate driver circuit and the data driver circuit simply need to operate at a normal speed, and the frame memory is not necessary. As a result, the quasi-impulse drive can be achieved at a low cost.

However, there are following issues in the liquid crystal display device of Patent Document 1. One is that the luminance of the liquid crystal display device is deteriorated, and the other is that the cost for the liquid crystal display device becomes increased for providing two gate drivers. The reasons will be described below.

The reasons for deteriorating the luminance are as follows. Typically, the liquid crystal display device provides displays through controlling a transmission light amount of light from a light source called a backlight at each pixel of the liquid crystal display device. Thus, the maximum luminance that can be displayed with the liquid crystal display device is determined according to the maximum luminance of the backlight and the maximum transmittance of the pixels of the liquid crystal display device. As one of the important factors for determining the maximum transmittance of the pixels, there is a numerical aperture. The numerical aperture herein is a ratio of an area of each pixel where the light transmits through with respect to an area that is a product of lateral and longitudinal pixel pitches which define a single pixel. Naturally, the higher the numerical aperture, the higher the maximum transmittance of the pixels becomes. As a result, the maximum luminance of the liquid crystal display device becomes increased as well.

With the liquid crystal display device of Patent Document 1, TFTs for writing black, the black signal supply command signal wiring, the black signal supplying wiring, and the like for controlling the TFTs are required in addition to the TFTs required for writing the video signal to each pixel and the wirings (scanning lines and the signal lines) for controlling the TFTs. Thus, the numerical aperture is deteriorated. Particularly, the area for the wirings cannot be reduced dramatically, unless the wirings are formed in a multilayer structure. Meanwhile, when the wirings are formed in a multilayer structure, there is generated another issue of increasing the process cost for the liquid crystal display device. Thus, it is difficult with the disclosed method to improve the luminance at a low cost.

The reasons for increasing the cost for the liquid crystal display device are as follows. Regarding the circuits which scan the gate lines and the like of the liquid crystal display device, it is typical to mount driver ICs on a substrate of the liquid crystal display device or to simultaneously fabricate the circuits on the substrate by using a same process for the pixel TFTs.

The liquid crystal display device of Patent Document 1 requires a scanning circuit for writing the black signals, in addition to the scanning circuit used for writing the normal video signals. Naturally, the cost is increased when separate driver ICs are used for the two scanning circuits. Meanwhile, even when the scanning circuits are fabricated on the substrate with TFTs, it is necessary to have an extra substrate for providing the layout for the scanning circuits. Normally, the liquid crystal display devices are manufactured by having a plurality of liquid crystal display devices arranged on a large-scale mother substrate. The process cost required for this manufacture is determined according to a unit of the mother substrate, and the cost for the individual liquid crystal display device is proportional to a value that is obtained by dividing the cost for the single mother substrate by the number of liquid crystal display devices disposed on the single mother substrate. Thus, when the area of the liquid crystal display device is increased, the number of liquid crystal display devices which can be disposed on the single mother substrate is decreased. This results in increasing the manufacturing cost. Because of the above-described reasons, the cost for the liquid crystal display device is increased with the method that requires two scanning circuits.

SUMMARY OF THE INVENTION

It is therefore an exemplary object of the present invention to provide a liquid crystal display device which is capable of improving the moving picture characteristic at a low cost by achieving high luminance of the liquid crystal display device which performs quasi-impulse drive.

In order to overcome the foregoing issues, the liquid crystal display device according to an exemplary aspect of the invention is a liquid crystal display device formed in a structure in which a liquid crystal is sandwiched between a first substrate and a second substrate, the first substrate including a plurality of pixels arranged in each area sectioned by a plurality of data lines and a plurality of gate lines, each of the pixels having a first switching device, a second switching device, a pixel capacitance, and a storage capacitance, wherein: the pixel capacitance and the storage capacitance are connected to the data line via the first switching device; the pixel capacitance and the storage capacitance are connected to a black signal supplying wiring via the second switching device; the first switching device is controlled by two of the gate lines that are different from each other; the second switching device is controlled by the two different gate lines; the two different gate lines have four periods in one frame period, including two periods in which potential levels of the two gate lines are same with respect to each other and two periods in which the potential levels are different from each other; the first switching device becomes electrically conductive in one of the four periods; and the second switching device becomes electrically conductive in one of the four periods, which is different from the period where the first switching device becomes electrically conductive.

A liquid crystal display device driving method according to another exemplary aspect of the invention is a method for driving the liquid crystal display device according to the present invention, which includes, in a frame period where video signals for one screen are supplied to the liquid crystal display device: writing the video signals to each of the pixels from the data lines via the first switching devices; and then writing black signals to each of the pixels from the black signal supplying wiring via the second switching device with a frequency that is a same frequency for writing the video signals.

As an exemplary advantage according to the invention, the black signals can be written by using a typical gate line at a normal operation speed. Thus, it is unnecessary to provide a gate line and a gate driver circuit for writing the black signals, so that one of following effects can be implemented.

(1) It is possible to improve the moving picture characteristic through achieving the quasi-impulse drive while suppressing the deterioration of the luminance.
(2) It is possible to achieve the quasi-impulse drive without increasing the cost for the liquid crystal display device.
(3) It is possible to decrease the power consumption, since the luminance can be adjusted in accordance with images to be displayed.

DETAILED DESCRIPTION OF THE EXEMPLARY EMBODIMENTS

Next, exemplary embodiments of the invention will be described in detail by referring to the accompanying drawings.

Figure 1:
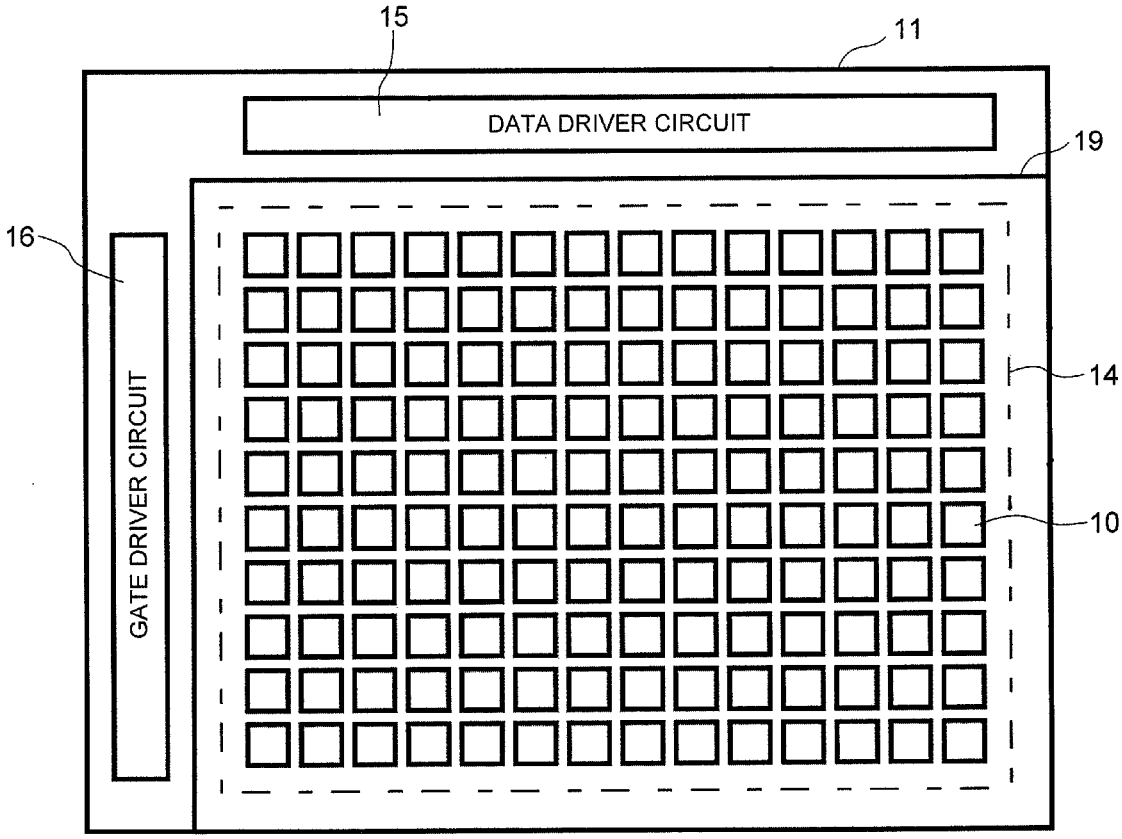
FIG. 1 is a block diagram of a liquid crystal display device according to the present invention.
Figure 2:
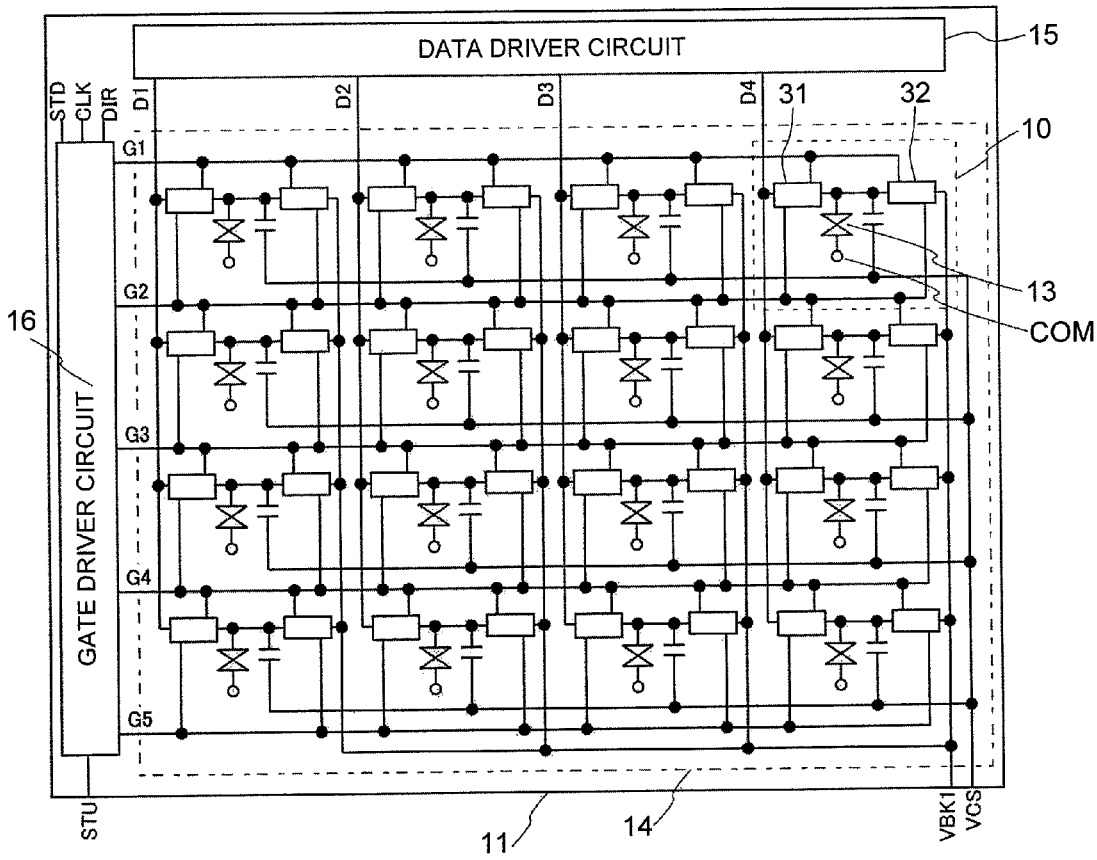
FIG. 2 is a block diagram and a circuit diagram of the liquid crystal display device according to the present invention.
Figure 3:
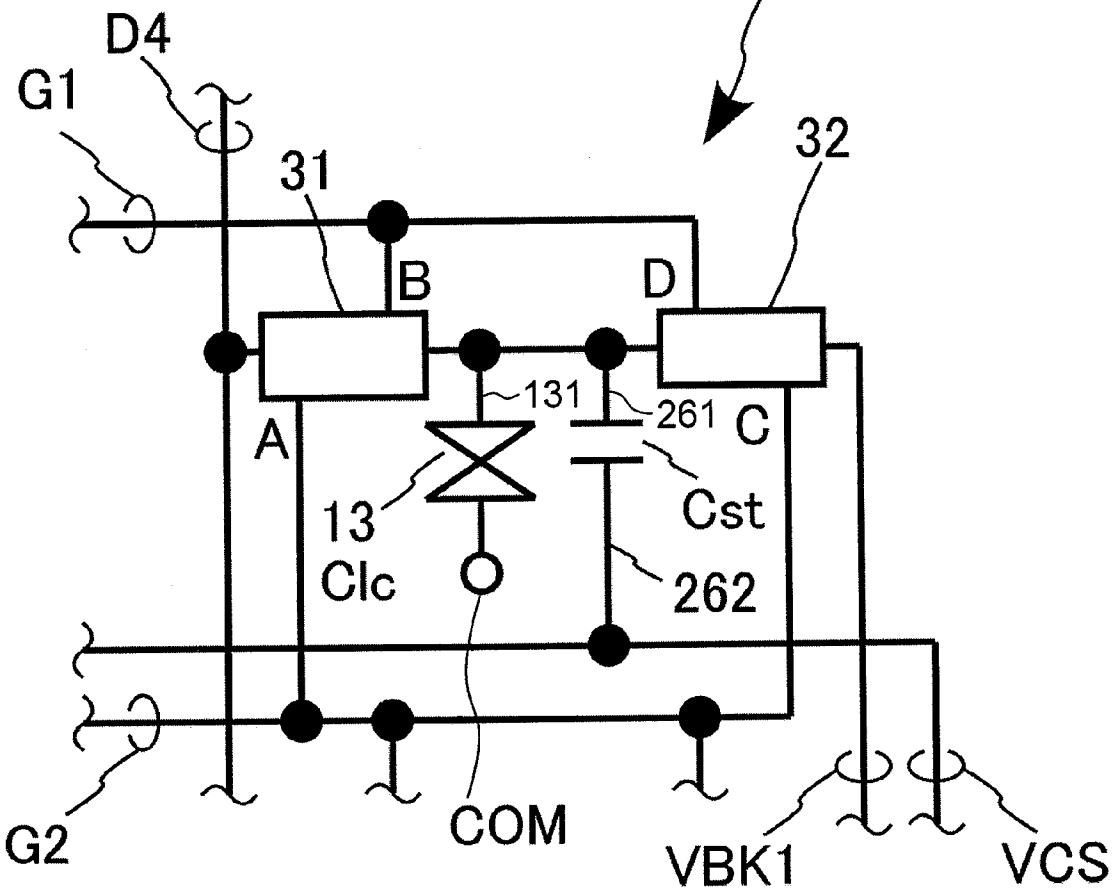
FIG. 3 is an enlarged circuit diagram showing a single pixel taken out from FIG. 2.

FIG. 1 is a block diagram of a liquid crystal display device according to an exemplary embodiment of the invention. FIG. 2 is a block diagram and a circuit diagram of a first substrate 11 shown in FIG. 1. FIG. 3 is an enlarged circuit diagram which shows a single pixel taken out from FIG. 2. Hereinafter, explanations will be provided by referring to FIG. 1, FIG. 2, and FIG. 3. Not only the pixel which is disposed between a gate line G1 and a gate line G2 and connected to a data line D4, but also all the other pixels are referred to as pixels 10.

As shown in FIG. 1, the liquid crystal display device according to the exemplary embodiment of the invention has a structure in which a liquid crystal 13 (FIG. 2) is sandwiched between the first substrate 11 and a second substrate 19. Further, as shown in FIG. 2, a plurality of data lines D1-D4 and a plurality of gate lines G1-G5 are disposed on the first substrate 11, and a pixel matrix 14 having pixels 10 arranged in matrix in each area sectioned with the data lines D1, - - - and the gate lines G1, - - - is disposed as well. A data driver circuit 15 and a gate driver circuit 16 for driving the data lines D1, - - - and the gate lines G1, - - - , respectively, are disposed in the periphery of the pixel matrix 14.

As shown in FIG. 3, the pixel 10 includes a first switching device 31, a second switching device 32, a pixel capacitance Clc, a storage capacitance Cst, and the like. The first switching device 31 has two control terminals A, B, and the control terminals A, B are connected to different gate lines G2 and G1 which are neighboring to each other. The second switching device 32 has two control terminals C, D, and the control terminals C, D are connected to different gate lines G2 and G1 which are neighboring to each other. The pixel capacitance Clc and the storage capacitance Cst are connected to the data line D4 via the first switching device 31, and connected to a black signal supplying wiring VBK1 via the second switching device 32. The pixel capacitance Clc is a capacitance configured with: an electrode 131 that is disposed on the first substrate 11 (FIG. 2) and connected to the first, second switching devices 31, 32; a common electrode COM that is the other electrode; and the liquid crystal 13 disposed between those two electrodes. The common electrode COM is disposed either on the first substrate 11 (FIG. 2) or the second substrate 19 (FIG. 1) depending on the liquid crystal mode. The other terminal 262, which is different from a terminal 261 of the storage capacitance Cst connected to the first and second switching devices 31 and 32, is connected to a wiring VCS.

In the liquid crystal display device according to the exemplary embodiment of the invention, within one-frame period, there are two periods where the potential levels of the two gate lines connected to the first switching device and the second switching device become consistent with each other, and two periods where those potential levels become inconsistent. The first switching device has a function of becoming electrically conductive in one of the four periods, and the second switching device has a function of becoming electrically conductive in a period that is different from the period where the first switching device becomes electrically conductive among the four periods. Therefore, in the liquid crystal display device according to the exemplary embodiment of the invention, it is possible to perform an operation of writing a video signal supplied from the data line to the liquid crystal capacitance Clc by the first switching device in one of the four periods and an operation of writing a black signal supplied from the black signal supplying wiring VBK1 in a period that is different from the period among the four periods where the first switching device writes the video signal to the liquid crystal capacitance.

With the exemplary embodiment of the invention, it is possible to improve the moving picture characteristic of the liquid crystal display device without increasing the cost and deteriorating the luminance.

As has been described earlier, the substrate on which the common electrodes COM are disposed differs depending on the liquid crystal mode. Normally, the common electrode COM are disposed on the second substrate in a TN (Twisted Nematic) mode and a VA (Vertical Alignment) mode, while the common electrode COM is disposed on the first substrate in an IPS (In-Plane Switching) mode and in an FFS (Fringe Field Switching) mode to supply a common voltage. However, the specific features of the present invention are in its connecting relations between the gate lines, the data lines, the first and second switching devices, the liquid crystal capacitance, the storage capacitance, and the black signal supplying wiring, the driving method of the gate lines, and the functions of the first and second switching devices, and the features of the present invention are not affected at all by the liquid crystal modes and which substrates the common electrode COM are disposed on.

Next, the liquid crystal display device according to the present invention will be described in more details by referring to a concretive example. The "transistor" depicted in a scope of appended claims corresponds to "TFT" in each of the exemplary embodiments.

First Exemplary Embodiment

Among the best modes for achieving the present invention, a first exemplary embodiment is a form of the liquid crystal display device of the present invention which performs an operation of writing the video signal supplied from the data line to the liquid crystal capacitance Clc by the first switching device and an operation of writing the black signal supplied from the black signal supplying wiring VBK1 to the liquid crystal capacitance by the second switching device through having the first switching device electrically conductive in one of the two periods where the potential levels of the two gate lines are different from each other and having the second switching device electrically conductive in the other one of the two periods where the potential levels of the two gate lines are different from each other. Hereinafter, as conditions where the first switching device becomes electrically conductive, a case where the first switching device becomes electrically conductive with A being high level and B being high level is expressed as "A·B", a case with A being low level and B being low level is expressed as "/A·/B", a case with A being low level and B being high level is expressed as "/A·B", and a case with A being high level and B being low level is expressed as "A·/B". Conditions of the second switching device are expressed in the same manner.

Figure 4:
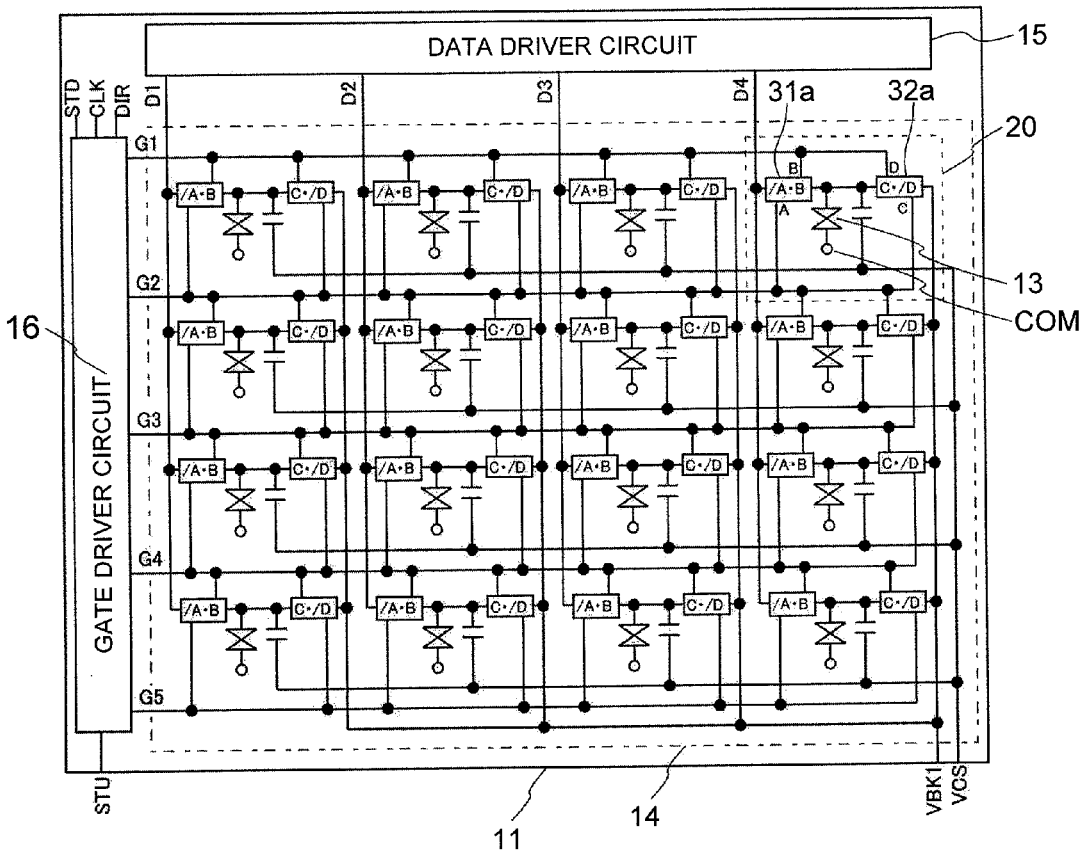
FIG. 4 is a block diagram and a circuit diagram showing a first exemplary embodiment of the liquid crystal display device according to the invention.

FIG. 4 is a block diagram and a circuit diagram of the liquid crystal display device as the first exemplary embodiment. In the liquid crystal display device according to the first exemplary embodiment, a first switching device 31*a* which configures each pixel 20 has its control terminal A connected to the gate line G2 and its control terminal B connected to the gate line G1. The first switching device 31*a* becomes electrically conductive, when the control terminal A is low level and the control terminal B is high level. A second switching device 32*a* has its control terminal C connected to the gate line G2 and its control terminal D connected to the gate line G1. The pixel capacitance Clc and the storage capacitance Cst are connected to the data lines (D1-D4) via the first switching device 31*a*, and connected to the black signal supplying wiring VBK1 via the second switching device 32*a*. The black signal supplying wiring VBK1 is common to all the pixels.

Figure 5:
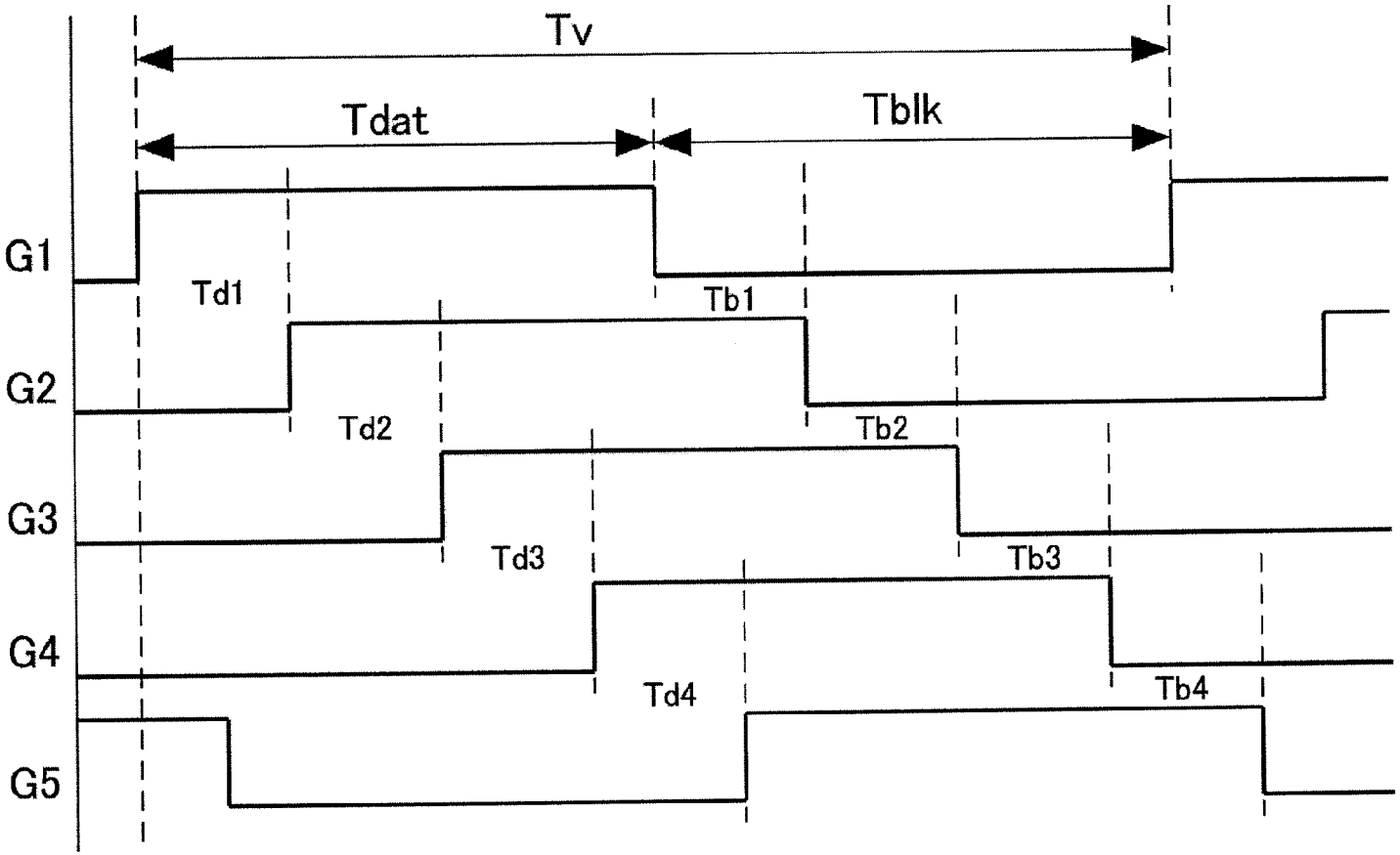
FIG. 5 is a timing chart showing operations of the liquid crystal display device shown in FIG. 4.

FIG. 5 is a timing chart which shows the operations of the liquid crystal display device according to the first exemplary embodiment. A period Tv shown in FIG. 5 indicates a frame period in which video signals for one frame are supplied from outside. A pulse whose high-level time is Tdat and low-level time is Tblk is outputted to each of the gate lines (G1-G5) by being shifted in terms of time.

Next, an operation of writing the video signals to the liquid crystal display device will be described. First, the operation for a first pixel row arranged between the gate lines G1 and G2 will be described. In the period Td1, the gate line G1 is high level, and the gate line G2 is low level. Therefore, in each pixel on the first pixel row, the first switching device 31*a* becomes electrically conductive, and the second switching device 32*a* comes to be in an open state. Through supplying the video signal corresponding to the first pixel row to the data lines (D1-D4) in this period, the video signals are written to the liquid crystal capacitances Clc and the storage capacitances Cst in each pixel of the first pixel row. In the period Td2, the gate line G1 becomes high level and the gate line G2 becomes high level as well. Thus, the first and the second switching devices 31*a* and 32*a* both come to be in an open state in each pixel on the first pixel row, and the video signals written in the period Td1 are held. In the meantime, in each pixel on a second pixel row arranged between the gate lines G2 and G3, the first switching device 31*a* becomes electrically conductive, and the second switching device 32*a* comes to be in an open state. Thus, the video signals supplied to the data lines (D1-D4) are written to the liquid crystal capacitances Clc and the storage capacitances Cst in each pixel on the second pixel row. Through performing such operations for all the pixel rows, the video signals for one screen can be written.

Next, an operation of writing the black signals to the liquid crystal display device will be described. In the period Tb1, the gate line G1 becomes low level, and the gate line G2 becomes high level. Therefore, in each pixel on the first pixel row, the second switching device 32*a* becomes electrically conductive, and the voltage of the black signal supplying wiring VBK1 is written to the liquid crystal capacitances Clc and the storage capacitances Cst. In the period Tb2, both the data line G1 and the gate line G2 become low level. Thus, the second switching device 32*a* comes to be in an open state in each pixel on the first pixel row. Therefore, the black signals are held. In the meantime, the gate line G3 is high level, so that the second switching device 32*a* on a second pixel row becomes electrically conductive. Thus, the black signals are written to the liquid crystal capacitances Clc and the storage capacitances Cst. Through performing such operations for all the pixel rows, the black signals for all the pixels can be written. Note here that the period Tb1 and the period Td4 overlap with each other in terms of time. This means that writing of the black signals to the first pixel row and writing of the video signals to the fourth pixel row are conducted simultaneously.

The operations of the liquid crystal display device can be summarized as follows.

In the liquid crystal display device, writing operations of the video signals and the black signals to each pixel are controlled by the two neighboring gate lines. In one-frame period, there are two periods where the voltage levels of the two gate lines become different, and two periods where the voltage levels become the same. The video signals are written in one of the two periods where the voltage levels are different, and the black signals are written in the other one of the two periods where the voltage levels are different. In the period where the writing operation of the video signals to an arbitrary pixel row is being executed, writing operations of the video signals for other pixel rows are not executed. However, writing operations of the black signals can be executed during that period.

Figure 6:
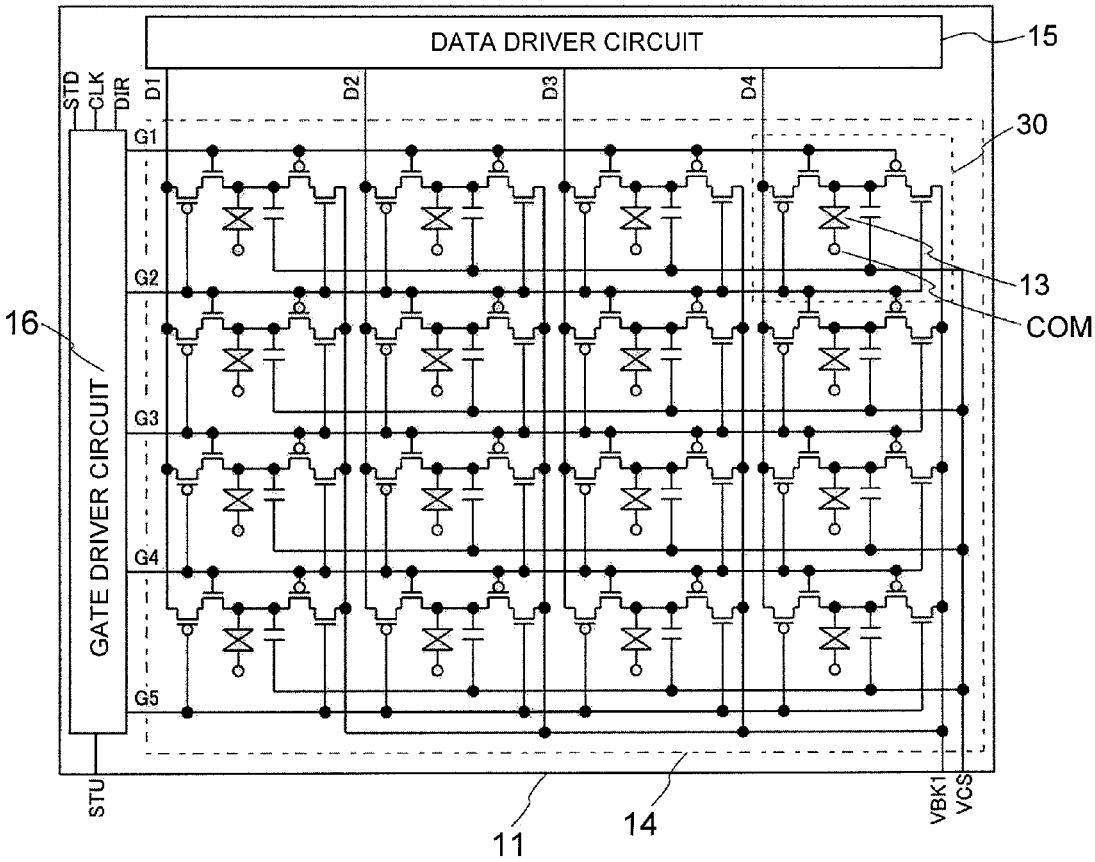
FIG. 6 is a detailed block diagram and a detailed circuit diagram showing the first exemplary embodiment of the liquid crystal display device according to the invention.
Figure 7:
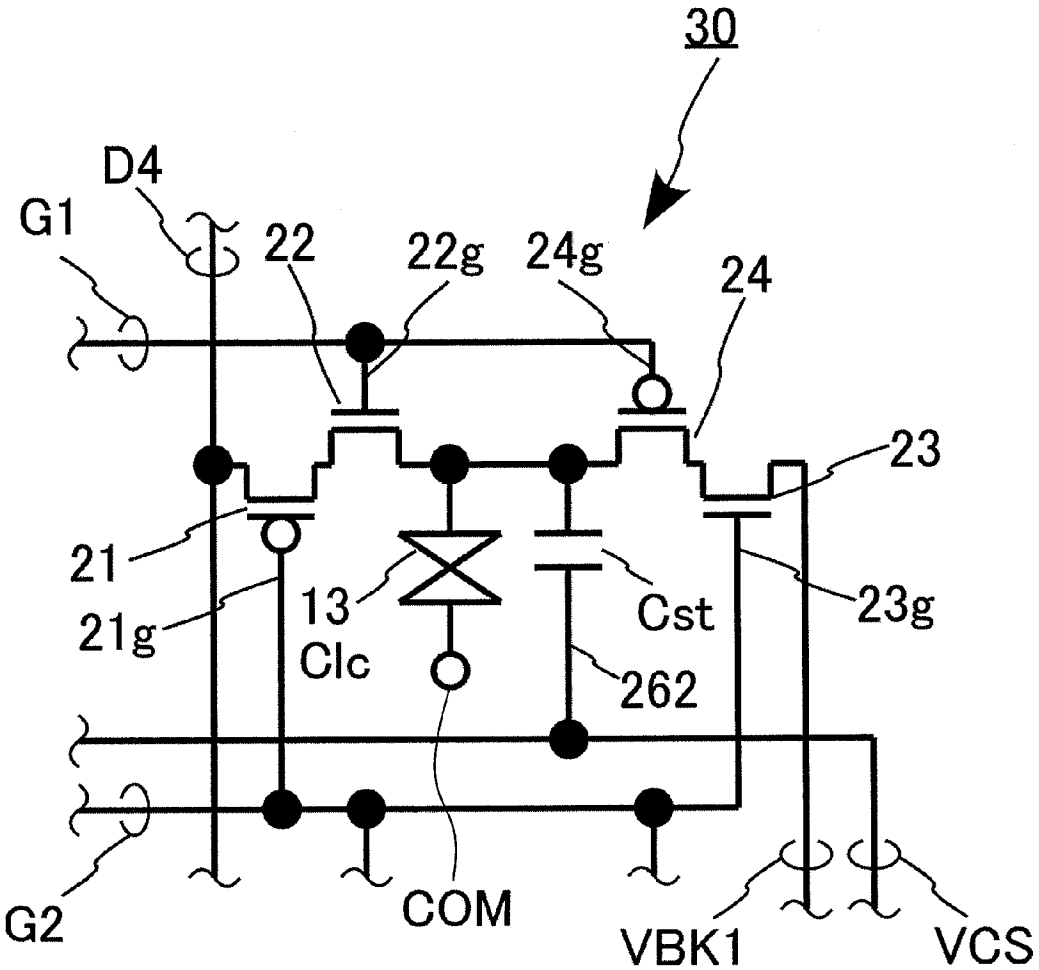
FIG. 7 is an enlarged circuit diagram showing a single pixel taken out from FIG. 6.

FIG. 6 is an illustration which shows a more specific structure of the liquid crystal display device as the first exemplary embodiment. FIG. 7 is an enlarged circuit diagram which shows a single pixel taken out from FIG. 6.

The liquid crystal display device of this exemplary embodiment has a structure in which a liquid crystal is sandwiched between a first substrate 11 and a second substrate 12. Provided on the substrate 11 are: a pixel matrix 14 in which pixels 30 are disposed in matrix; a data driver circuit 15 for driving data line D1-D4; and a gate driver circuit 16 for driving gate lines G1-G5. At each of the intersection points between the plurality of data lines D1-D4 and the plurality of gate lines G1-G5 disposed in matrix, the pixel 30 at least has TFTs 21-24 as a plurality of pixel TFTs, the liquid crystal capacitance Clc, and the storage capacitance Cst.

Next, connections of the pixels on the pixel row between the gate lines G1 and G2 will be described for providing explanations regarding the connecting relations in each pixel 30.

The TFTs 21 and 22 which configures the first switching device are of different conductive types from each other, and respective gate electrodes 21*g* and 22*g* are connected to the neighboring gate lines G2 and G1 which are different from each other. Either the source electrode or the drain electrode of the TFT 21 is connected to the data line D4, and the other electrode is connected to the source electrode or the drain electrode of the TFT 22. The other electrode (out of the source electrode and the drain electrode) of the TFT 22 is connected to the liquid crystal capacitance Clc and the storage capacitance Cst.

The TFTs 23 and 24 which configure the second switching device are of different conductive types from each other, and respective gate electrodes 23*g* and 24*g* are connected to the neighboring gate lines G2 and G1 which are different from each other. Either the source electrode or the drain electrode of the TFT 23 is connected to the black signal supplying wiring VBK1, and the other electrode is connected to the source electrode or the drain electrode of the TFT 24. The other electrode (out of the source electrode and the drain electrode) of the TFT 24 is connected to the liquid crystal capacitance Clc and the storage capacitance Cst. The TFTs 21 and 24 are of a same conductive type with respect to each other. The respective gate electrodes 21*g* and 23*g* of the TFTs 21 and 23 are connected to the same gate line G2.

That is, in the liquid crystal display device as the first exemplary embodiment, two each of the TFTs which configure the first and second switching devices of each pixel are of different conductive types.

The structures of each pixel 30 on other pixel rows are the same as the structure of the pixel 20 shown in FIG. 5, except for the gate lines G1-G5 and data lines D1-D4 to be connected. Note that the structure shown in the drawing illustrate the case of a TN (Twisted Nematic) mode, a VA (Vertical Alignment) mode, and the like, so that the common electrodes COM are formed on the first substrate 11.

The gate driver circuit 16 is controlled at least by a start signal STD and a clock signal CLK, and has a function of outputting the start signal STD to each of the gate lines G1-G5 while sequentially shifting it by synchronizing with the clock signal. It is also possible to use a gate driver circuit 16 that has a function capable of changing the scanning direction with two start signals STD, STU, and a shift direction control signal DIR. FIG. 6 shows a case which uses the gate driver circuit 16 that has the function capable of changing the shift direction.

Figure 8:
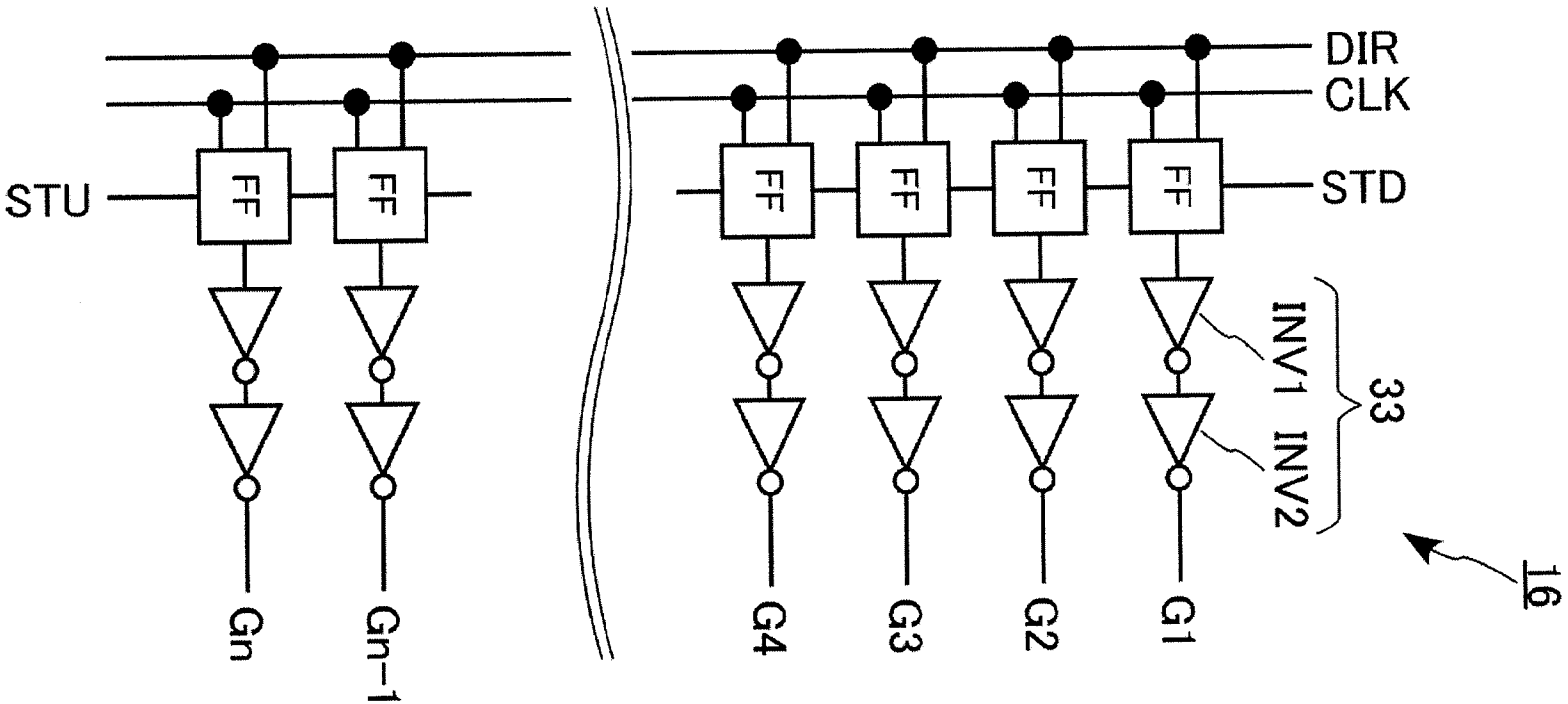
FIG. 8 is a block diagram showing an example of a gate driver circuit of FIG. 6.

As a structural example of the gate driver circuit 16 having such function, there is a circuit shown in FIG. 8. This gate driver circuit 16 is configured with: a plurality of serially connected flip-flop circuits FF capable of performing bidirectional shifting; and buffer circuits 33 provided on the output sides of each of the flip-flops FF. FIG. 8 shows a case in which the buffer circuit 33 is configured with two-step inverters INV1 and INV2. However, there are cases where the buffer circuits 33 are not essentially required, depending on the loads of the gate lines G1, - - - .

Figure 9:
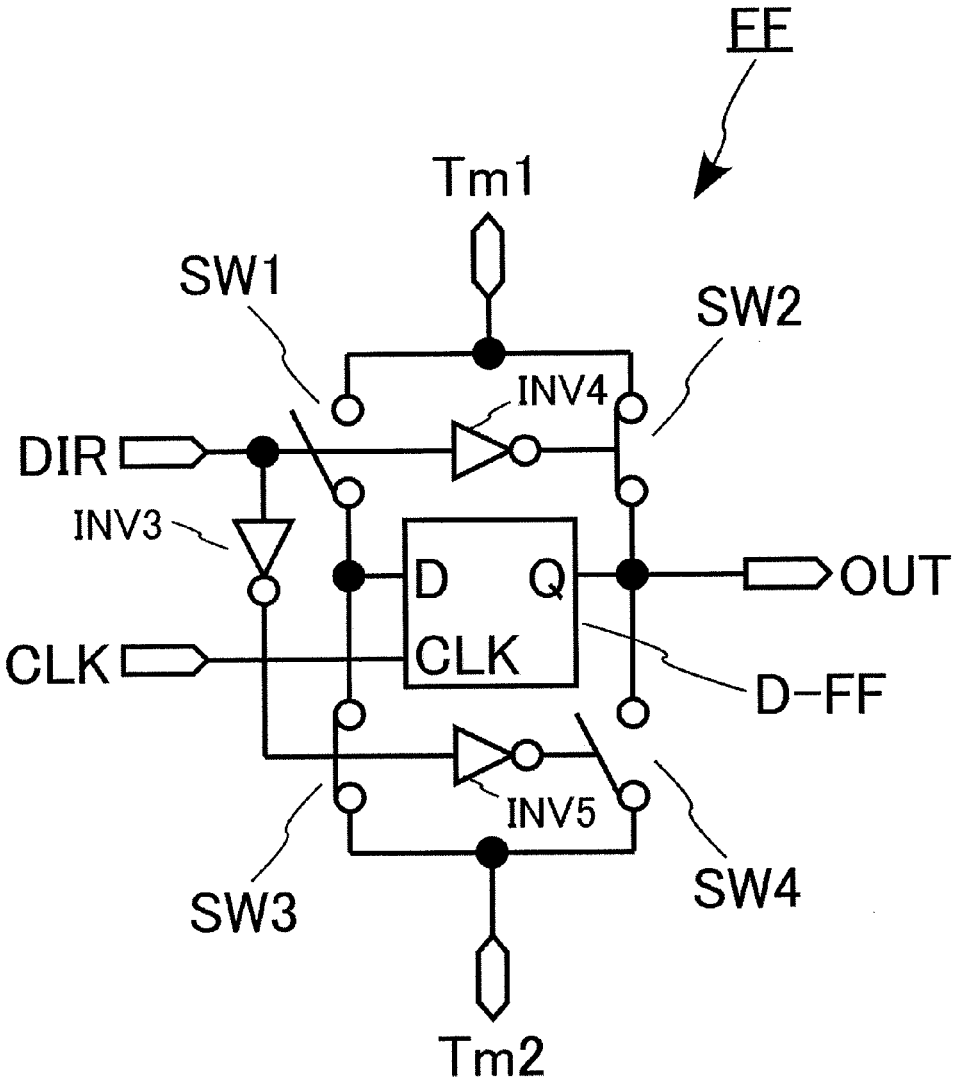
FIG. 9 is a circuit diagram showing an example of a flip-flop of FIG. 8.

As a structural example of the flip-flop FF capable of performing bidirectional shifting, it is possible to use a circuit shown in FIG. 9. The flip-flop FF capable of bidirectional shifting is configured with a D flip-flop D-FF, switches SW1-SW4, and inverters INV3-INV5. The shift direction control signal DIR is used to control for opening/closing the switches SW1-SW4 for connecting one of terminals Tm1, Tm2 to an input terminal D of the D flip-flop D-FF, and for connecting the other (out of the terminals Tm1, Tm2) to an output terminal Q.

For example, provided that the switches SW1, SW4 are in an electrically conductive state while the switches SW2, SW3 are in an electrically non-conductive state when the shift direction control signal DIR is high level, the terminal Tm1 is connected to the input terminal D of the D flip-flop D-FF, and the terminal Tm2 is connected to the output terminal Q of the D flip-flop D-FF. Therefore, the flip-flop FF performs a shift operation which latches the signal of the terminal Tm1 by synchronizing with the clock signal CLK, and outputs it to the terminal Tm2 and a terminal OUT with a delay of one clock.

According to this rule, when the shift direction control signal DIR is low level, the flip-flop FF performs an operation which latches the signal of the terminal Tm2 by synchronizing with the clock signal CLK, and outputs it to the terminal Tm1 and the terminal OUT with a delay of one clock. This makes it possible to change the shift direction by the shift direction control signal DIR. Note here that the D flip-flop D-FF performs an operation which latches the signal of the input terminal D by synchronizing with the clock signal CLK, and outputs it to the output terminal Q with a next clock signal CLK.

Next, a driving method of the liquid crystal display device according to the exemplary embodiment, i.e., operations of the liquid crystal display device according to the exemplary embodiment, will be described by mainly referring to a timing chart shown in FIG. 10.

Figure 10:
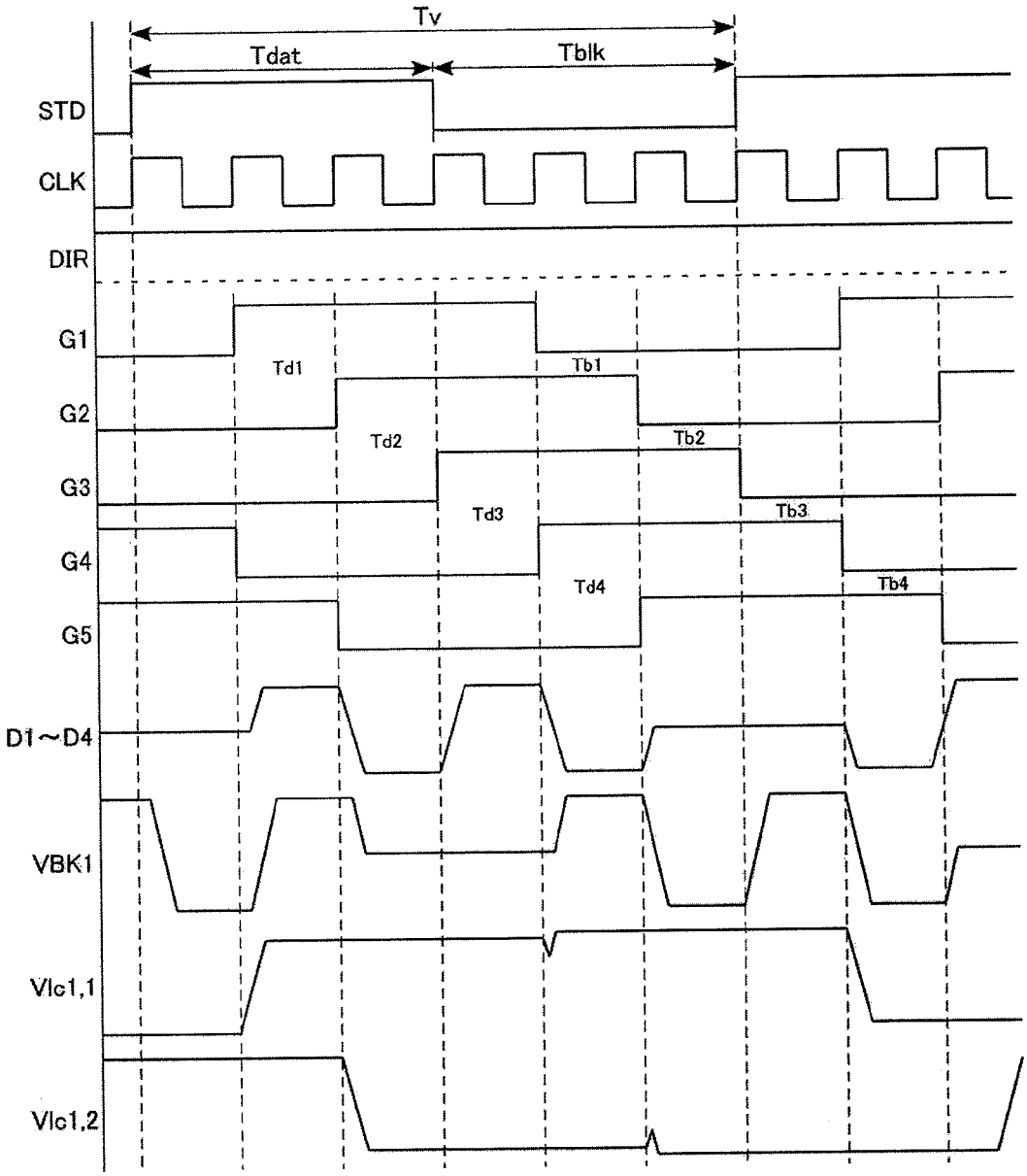
FIG. 10 is a timing chart showing operations of the liquid crystal display device shown in FIG. 6.

A period Tv in FIG. 10 indicates a frame period in which video signals for one frame are supplied from outside. The start signal STD of the gate driver circuit 16 is set to high level by synchronizing with the period Tv. Upon this, the start signal STD is transferred by being synchronized with the clock signal CLK, and outputted from each of the output terminals (gate lines G1, - - - ) of the gate driver circuit 16.

In a period Td1 in FIG. 10, the gate line G1 becomes high level and the gate line G2 stays low level. Thus, at the pixels 30 on the pixel row between the gate line G1 and the gate line G2, the TFTs 21 and 22 both become electrically conductive, so that the video signals supplied to the data lines D1-D4 are written to the liquid crystal capacitances Clc and the storage capacitances Cst. At this time, the TFTs 23 and 24 are both in an open state.

In a period Td2 in FIG. 10, the gate line G1 stays high level, while the gate line G2 turns to high level. Thus, the TFTs 22 come to be in an electrically conductive state, while the TFTs 21 come to be in an electrically non-conductive state. Therefore, the liquid crystal capacitances Clc and the storage capacitances Cst are electrically disconnected from the data lines D1-D4. At this time, the TFTs 23 come to be in an electrically conductive state, while the TFTs 24 are in an electrically non-conductive state. Therefore, the liquid crystal capacitances Clc and the storage capacitances Cst remain as being electrically disconnected from the black signal supplying wiring VBK1, and the video signals written in the period Td1 are kept at the pixels 30.

Through performing such operations for all the pixel rows, the video signals for one screen can be written to the pixel matrix 14. In the period Tv, the start signal STD is high level in a period Tdat. Thus, each output of the gate driver circuit 16 becomes high level for a same length of time as that of the period Tdat.

Therefore, in the period Tb1 of FIG. 10, the gate line G1 changes to low level. At this time, the TFTs 21 and 22 are both in an open state at the pixels 30 on the pixel row between the gate line G1 and the gate line G2. However, the TFTs 23 and 24 both come to be in an electrically disconnected state, so that the voltage of the black signal supplying wiring VBK1 is written to the liquid crystal capacitances Clc and the storage capacitances Cst.

In the period Tb2 of FIG. 10, the gate line G2 also changes to low level. Thus, the TFTs 23 change to be in an electrically non-conductive state, and the liquid crystal capacitances Clc and the storage capacitances Cst are electrically disconnected from the black signal supplying wiring VBK1. At this time, the TFTs 21 change to be in an electrically conductive state, while the TFTs 22 stay in an open state. Therefore, the liquid crystal capacitances Clc and the storage capacitances Cst are remained to be electrically disconnected from the data lines D1-D4. With this, the black signals written in the period Tb1 are held at the pixels 30.

Through performing such operations for all the pixel rows, the black signals can be written to all the pixels 30 sequentially by a row unit. A voltage Vlc1,1 in FIG. 10 shows the voltage of the pixel 30 connected to the data line D1, which is disposed between the gate line G1 and the gate line G2. Similarly, a voltage Vlc1,2 shows the voltage of the pixel 30 connected to the data line D1, which is disposed between the gate line G2 and the gate line G3.

Figure 11:
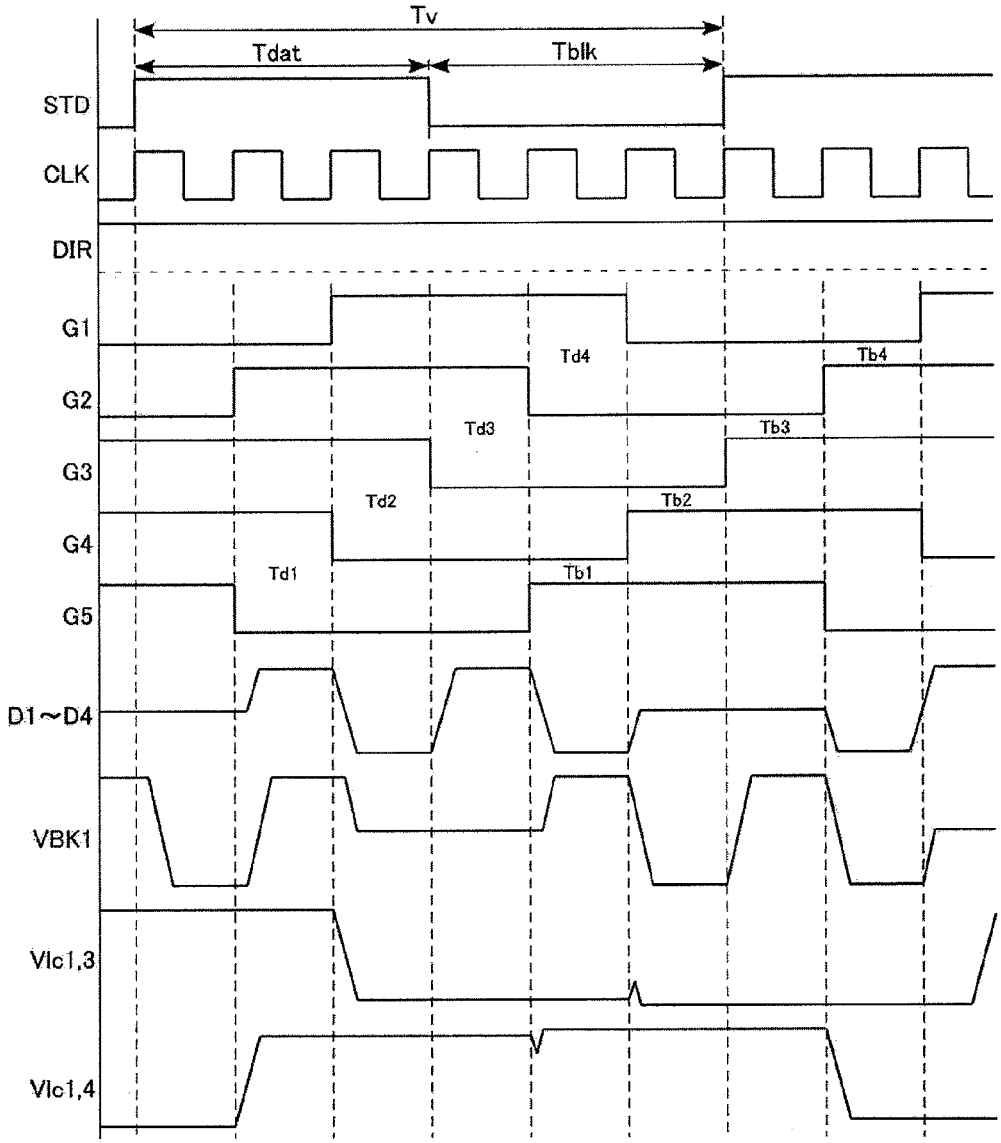
FIG. 11 is another timing chart showing operations of the liquid crystal display device shown in FIG. 6.

FIG. 11 shows operations when starting writing of the video signals from the pixel row of the gate line G5. In the period Tv of one frame in FIG. 11, the start signal STU of the gate driver circuit 16 is set to low level. Upon this, the start signal STU is transferred by being synchronized with the clock signal CLK, and outputted from each of the output terminals (gate lines G1, - - - ) of the gate driver circuit 16.

In the period Td1 of FIG. 11, the gate line G5 changes from high level to low level, while the gate line G4 stays high level. Thus, the TFTs 21 and 22 become electrically conductive at the pixels 30 on the pixel row between the gate line G4 and the gate line G5, and the TFTs 23 and 24 are in an open state. Therefore, the video signals written to the data lines D1-D4 are written to the liquid crystal capacitances Clc and the storage capacitances Cst.

In the period Td2 of FIG. 11, the gate line G4 changes to low level. Thus, the TFTs 22 change to be in an open state, while the TFTs 21 are in an electrically conductive state. Therefore, the liquid crystal capacitances Clc and the storage capacitances Cst are electrically disconnected from the data lines D1-D4. Further, the TFTs 23 are in an electrically non-conductive state, and the TFTs 24 are in an electrically conductive state. Thus, the liquid crystal capacitances Clc and the storage capacitances Cst also remain to be electrically disconnected from the black signal supplying wiring VBK1. With this, the video signals written in the period Td1 are held at the pixels 30.

Through performing such operations for all the pixel rows, the video signals for one screen can be written to the pixel matrix 14. In the period Tv, the start signal STD is low level in the period Tdat. Thus, each output of the gate driver circuit 16 becomes low level for a same length of time as that of the period Tdat.

Therefore, in the period Tb1 of FIG. 11, the gate line G5 changes to high level. At this time, the TFTs 21 and 22 are both in an open state at the pixels 30 on the pixel row between the gate line G4 and the gate line G5. However, the TFTs 23 and 24 both come to be in an electrically conductive state, so that the voltage of the black signal supplying wiring VBK1 is written to the liquid crystal capacitances Clc and the storage capacitances Cst.

In the period Tb2 of FIG. 11, the gate line G4 also changes to high level. Thus, the TFTs 24 change to be in an open state, and the liquid crystal capacitances Clc and the storage capacitances Cst are electrically disconnected from the black signal supplying wiring VBK1. At this time, the TFTs 22 change to be in an electrically conductive state, while the TFTs 21 stay in an electrically non-conductive state. Therefore, the liquid crystal capacitances Clc and the storage capacitances Cst are remained to be electrically disconnected from the data lines D1-D4. With this, the black signals written in the period Tb1 are held at the pixels 30.

Through performing such operations for all the pixel rows, the black signals can be written to all the pixels 30 sequentially by a row unit. A voltage Vlc1,4 in FIG. 11 shows the voltage of the pixel 30 connected to the data lines D1, which is also disposed between the gate line G4 and the gate line G5. Similarly, a voltage Vlc1,3 in FIG. 11 shows the voltage of the pixel 30 connected to the data lines D1, which is disposed between the gate line G4 and the gate line G3.

As has been described above, the liquid crystal display device according to the exemplary embodiment performs the operations to write the video signals to all the pixels 30 in one-frame period by a row unit to display the video signals for the length of the period Tdat, and then to write the black signals to all the pixels 30 by row unit to display black for the length of the period Tblk.

Further, the period for displaying the video signals and the period for displaying the black signals can be changed with the time in which the start signals STD and STU of the gate driver circuit 16 are set to high level or low level. Furthermore, it is also possible to vertically invert the image displayed in the liquid crystal display device through changing the scanning direction of the gate driver circuit 16.

Further, the black signal supplying wiring VBK1 is common to all the pixels 30. Thus, it is possible to employ a method in which the polarities of the black signals written to each pixel 30 for the common electrodes COM that is the other electrode configuring the liquid crystal capacitance Clc are set to be the same for each pixel row and set to be different for the pixel rows neighboring to each other vertically, and to employ a method in which the polarities of the black signals written to all the pixels 30 for the common electrodes COM are set to be the same in one-frame period. FIG. 10 and FIG. 11 illustrate an example of the method in which the polarities of the black signals for the common electrodes COM are set to be the same for each pixel row.

As described, it is the feature of the liquid crystal display device driving method according to the exemplary embodiment to: write the video signals to each pixel 30 from the data lines D1-D4 via the TFTs 21 and 22 which configure the first switching devices in a frame period where the video signals for one screen are supplied to the liquid crystal display device of the exemplary embodiment; and then write the black signals to each pixel 30 via the TFTs 23 and 24 which configure the second switching devices from the black signal supplying wiring VBK1 with the same frequency as the frequency for writing the video signals. In other words, the liquid crystal display device driving method of the exemplary embodiment can be so characterized that: the video signals are written to each pixel 30 from the data lines D1-D4 via the first switching devices in a frame period where the video signals for one screen are supplied to the liquid crystal display device of the exemplary embodiment; the black signals are written to each pixel 30 via the second switching devices from the black signal supplying wiring VBK1; the frequency for writing the video signals and the frequency for writing the black signals are the same; and the timing for writing the video signals and the timing for writing the black signals are different.

In the above, the exemplary embodiment has been described by referring to the case where four pixels 30 each are arranged longitudinally and vertically. However, the number of pixels 30 has no influence upon the essentials of the present invention. Further, regarding the conductive types of the TFTs 21-24, it is possible to employ n-channel type TFTs 21, 24 and p-channel type TFTs 22, 23. In that case, the logics of the gate driver circuit 16 may be inverted. The structure of the gate driver circuit 16 is not limited to the structure described above, as long as it has a function of transferring the start signals STD and STU sequentially by synchronizing with the clock signal CLK.

Next, effects of the liquid crystal display device according to the exemplary embodiment will be described.

With the liquid crystal display device of the exemplary embodiment, it is possible to improve the moving picture characteristic by achieving the quasi-impulse drive without deteriorating the luminance. The reason is that the black signals are written to the liquid crystal capacitances Clc and the storage capacitances Cst of each pixel 30, so that it is unnecessary to provide the gate lines used exclusively for the black signals, unlike the case of Patent Document 1. Therefore, the numerical aperture of the pixels 30 can be increased, thereby making it possible to prevent the deterioration of the luminance.

Further, with the liquid crystal display device of the exemplary embodiment, it is possible to achieve the quasi-impulse drive without inducing a cost increase compared to the cases of the conventional liquid crystal display devices. The reasons are as follows. Firstly, it is possible to write the black signals to the liquid crystal capacitances Clc and the storage capacitances Cst of each pixel 30 without requiring the gate driver used for writing the black signals. Thus, there is no cost increase. Even in a case where the gate driver circuit 16 is formed on the substrate 11 with the same process as that of the pixel TFTs (TFTs 21-24), it is unnecessary to keep the place for the gate driver circuit for writing the black signals on the layout of the substrate. Therefore, the external size of the liquid crystal display device can be suppressed smaller. As a result, it is unnecessary to decrease the number of liquid crystal display devices placed on a single mother substrate because of the functions of the present invention, so that there is no cost increase. Secondly, since the video signal and the black signal can be displayed in one-frame period without increasing the operating frequency of the liquid crystal display device, it is unnecessary to use high-speed operative circuits for the data driver circuit 15 and the gate driver circuit 16. Further, it is also unnecessary to provide a frame memory for converting the frequency of the video image. Therefore, there is no cost increase.

Furthermore, with the liquid crystal display device of the exemplary embodiment, it becomes possible to adjust the luminance depending on the displayed images. Thus, the power consumption can be decreased. The reason is that the proportion of the period for displaying the video signal and the period for displaying the black signal in one-frame period can be adjusted through changing the lengths of the period Tdat and the period Tblk in the start signals STD and STU. For example, in a case where mainly still pictures are to be displayed, it is possible to decrease the power consumption by increasing the luminance by setting the period Tdat to be longer, or, decreasing the luminance of a backlight without changing the luminance of the liquid crystal display device.

Second Exemplary Embodiment

Figure 12:
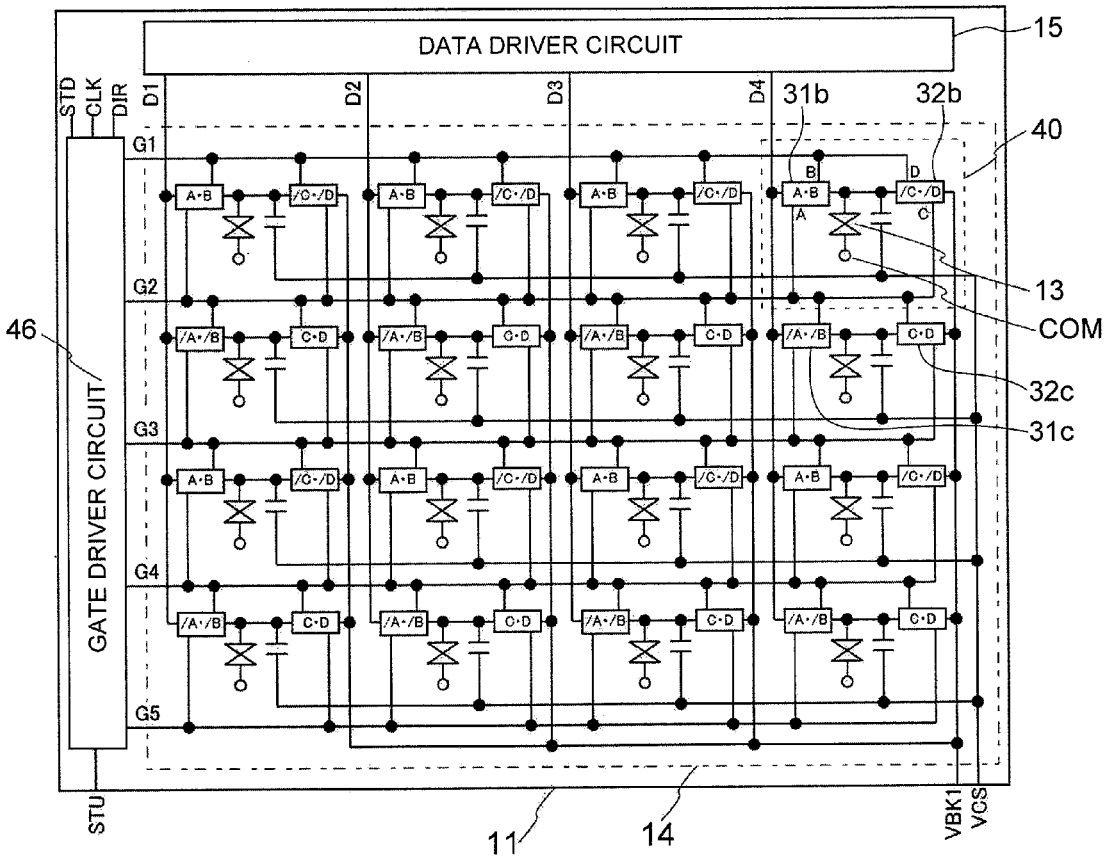
FIG. 12 is a block diagram and a circuit diagram showing a second exemplary embodiment of the liquid crystal display device according to the invention.

FIG. 12 is a block diagram and a circuit diagram of a liquid crystal display device as a second exemplary embodiment. In the liquid crystal display device of the second exemplary embodiment, a control terminal A of a first switching device 31*b* configuring each pixel 40 is connected to the gate line G2, and a control terminal B is connected to the gate line G1. Provided that the pixel row sandwiched between the gate lines G1 and G2 is a first pixel row, both of the control terminals A and B of the first switching device 31*b* in an odd-numbered pixel row become electrically conductive under high level, and both of the control terminals C and D of the second switching device 32*b* become electrically conductive under low level. In an even-numbered pixel row, both of the control terminals A and B of the first switching device 31*c* become electrically conductive under low level, and both of the control terminals C and D of the second switching device 32*c* become electrically conductive under high level. The pixel capacitance Clc and the storage capacitance Cst are connected to the data lines (D1-D4) via the first switching devices 31*b*, 32*b*, and connected to the black signal supplying wiring VBK1 via the second switching devices 32*b*, 32*c*. The black signal supplying wiring VBK1 is common to all the pixels.

Figure 13:
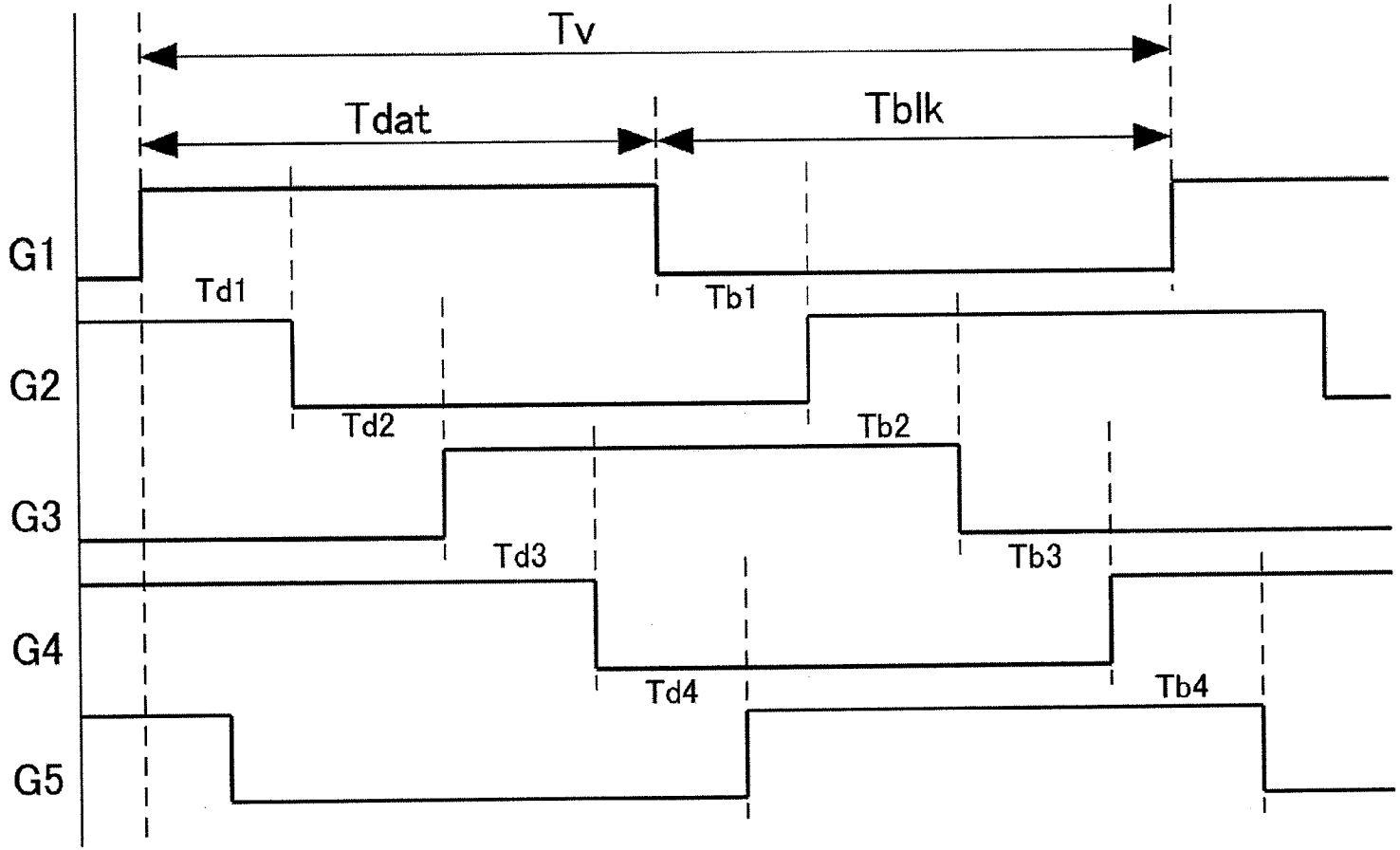
FIG. 13 is a timing chart showing operations of the liquid crystal display device shown in FIG. 12.

FIG. 13 is a timing chart showing operations of the liquid crystal display device of the second exemplary embodiment. The period Tv in FIG. 13 indicates a frame period in which the video signals for one frame are supplied from outside. In the odd-numbered gate lines (G1, G3, G5), a pulse in which high-level time is Tdat and low-level time is Tblk is outputted by being shifted in terms of time. Meanwhile, in the even-numbered gate lines (G2, G4), a pulse in which low-level time is Tdat and high-level time is Tblk is outputted by being shifted in terms of time.

Next, an operation of writing the video signals to the liquid crystal display device will be described. First, the operation for a first pixel row arranged between the gate lines G1 and G2 will be described. In the period Td1, the gate line G1 and the gate line G2 are both high level. Therefore, in each pixel on the first pixel row, the first switching device 31*b* becomes electrically conductive, and the second switching device 32*b* comes to be in an open state. In this period, the video signals are written to the liquid crystal capacitances Clc and the storage capacitances Cst in each pixel of the first pixel row through supplying the video signals corresponding to the first pixel row to the data lines (D1-D4). In the period Td2, the gate line G1 becomes high level and the gate line G2 becomes low level. Thus, the first and the second switching devices 31*b* and 32*b* both come to be in an open state in each pixel on the first pixel row, and the video signals written in the period Td1 are held. In the meantime, in each pixel on a second pixel row arranged between the gate lines G2 and G3, the first switching device 31*c* becomes electrically conductive, and the second switching device 32*c* comes to be in an open state since the gate line G3 is low level. Thus, the video signals supplied to the data lines (D1-D4) are written to the liquid crystal capacitances Clc and the storage capacitances Cst in each pixel on the second pixel row. Through performing such operations for all the pixel rows, the video signals for one screen can be written.

Next, an operation of writing the black signals to the liquid crystal display device will be described. In the period Tb1, the gate line G1 and the gate line G2 both become low level. Therefore, in each pixel on the first pixel row, the second switching device 32*b* becomes electrically conductive, and the voltage of the black signal supplying wiring VBK1 is written to the liquid crystal capacitances Clc and the storage capacitances Cst. In the period Tb2, the data line G1 becomes low level, and the gate line G2 become high level. Thus, the second switching device 32*b* comes to be in an open state in each pixel on the first pixel row. Therefore, the black signals are held. In the meantime, the gate line G3 is high level, so that the second switching device 32*c* on a second pixel row becomes electrically conductive. Thus, the black signals are written to the liquid crystal capacitances Clc and the storage capacitances Cst. Through performing such operations for all the pixel rows, the black signals for all the pixels can be written. Note here that the period Tb1 and the period Td4 overlap with each other in terms of time. This means that writing of the black signals to the first pixel row and writing of the video signals to the fourth pixel row are conducted simultaneously.

The operations of the liquid crystal display device can be summarized as follows.

In the liquid crystal display device, writing operations of the video signals and the black signals to each pixel are controlled by the two neighboring gate lines. In one-frame period, there are two periods where the voltage levels of the two gate lines become different, and two periods where the voltage levels become the same. The video signal is written in one of the periods where the voltage levels are different, and the black signal is written in the other period where the voltage levels are different. In the period where the writing operation of the video signal to an arbitrary pixel row is being executed, writing operations of the video signal for other pixel rows are not executed. However, writing operations of the black signal can be conducted during that period.

Figure 14:
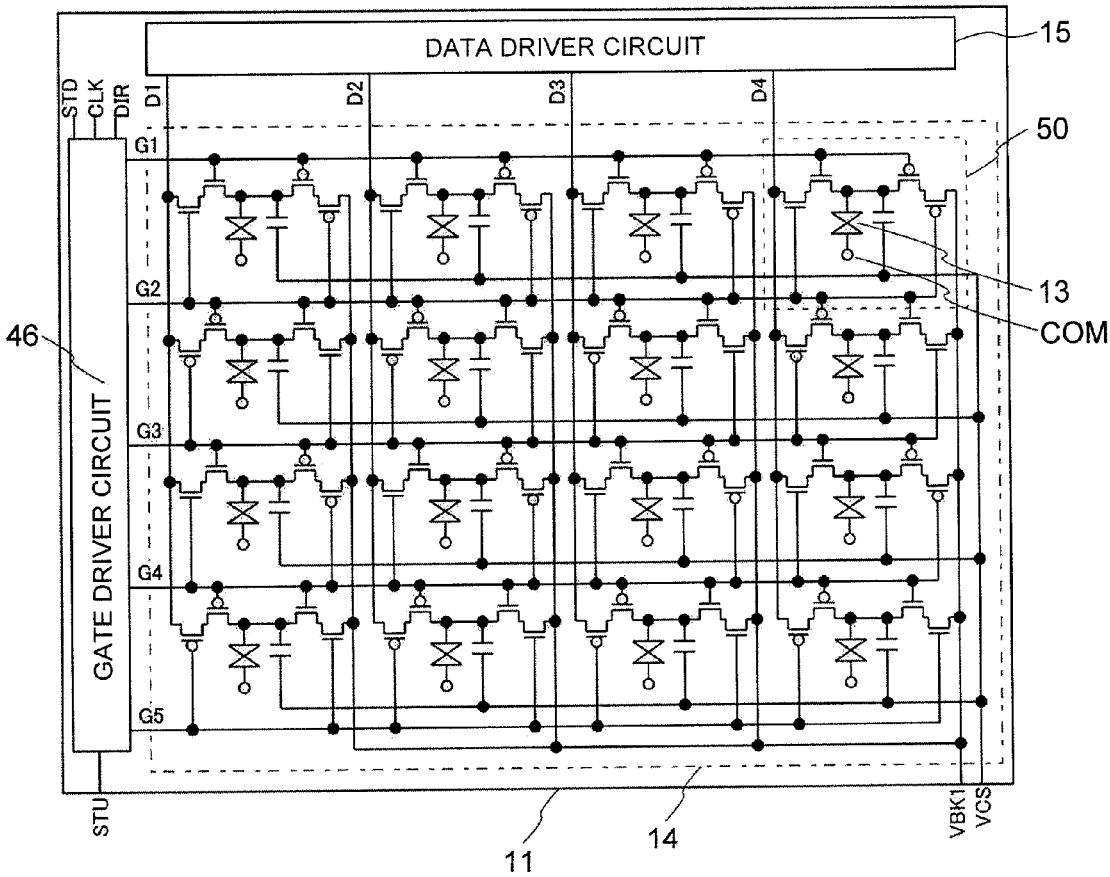
FIG. 14 is a detailed block diagram and a detailed circuit diagram showing the second exemplary embodiment of the liquid crystal display device according to the invention.
Figure 15:
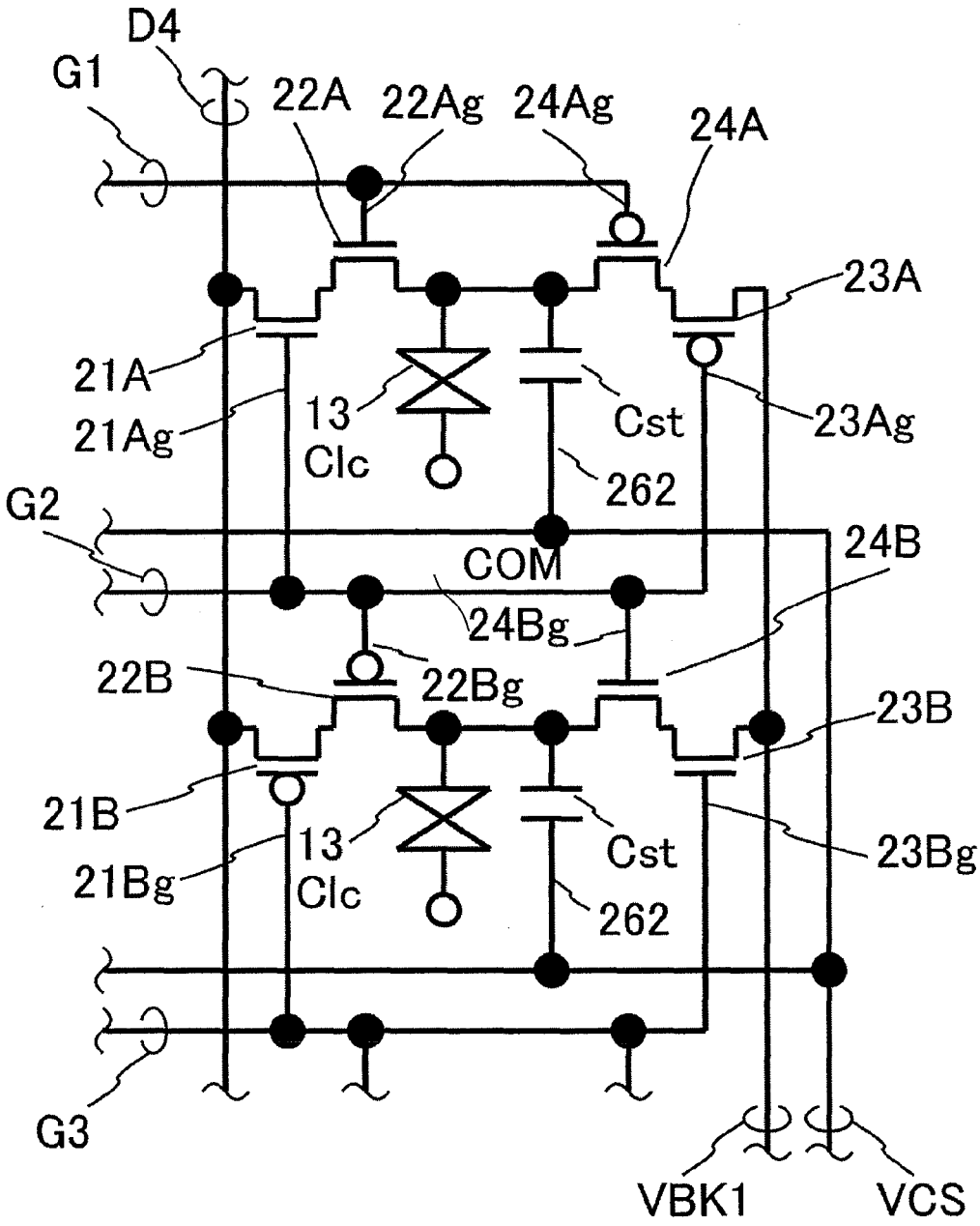
FIG. 15 is an enlarged circuit diagram showing two pixels taken out from FIG. 14.

FIG. 14 is an illustration which shows a more specific structure of the liquid crystal display device as the second exemplary embodiment. FIG. 15 is an enlarged circuit diagram which shows two single pixels taken out from FIG. 14.

The liquid crystal display device of this exemplary embodiment has a structure in which a liquid crystal is sandwiched between a first substrate 11 and a second substrate 12. Provided on the substrate 11 are: a pixel matrix 14 in which pixels 50 are disposed in matrix; a data driver circuit 15 for driving data line D1-D4; and a gate driver circuit 16 for driving gate lines G1-G5. At each of the intersection points between the plurality of data lines D1-D4 and the plurality of gate lines G1-G5 disposed in matrix, the pixel 50 at least has TFTs 21-24 as a plurality of pixel TFTs, the liquid crystal capacitance Clc, and the storage capacitance Cst.

Next, connections in each of the pixels on the odd-numbered pixel row and the even-numbered pixel row will be described for providing explanations regarding the connecting relations in each pixel 50. Note here that "odd-numbered pixel row" and "even-numbered pixel row" indicate the odd-numbered pixel row and the even-numbered pixel row of the pixel rows disposed in parallel to the gate lines, assuming that the pixel row between the gate lines G1 and G2 is numbered as "1".

Regarding each pixel on the first pixel row that is an odd-numbered pixel row, TFTs 21A and 22A configuring the first switching device are of a same conductive type, and respective gate electrodes 21Ag and 22Ag are connected to the neighboring gate lines G2 and G1 which are different from each other. Either the source electrode or the drain electrode of the TFT 21A is connected to one of the data lines D1-D4, and the other electrode is connected either to the source electrode or the drain electrode of the TFT 22A. The other electrode (out of the source electrode and the drain electrode) of the TFT 22A is connected to the liquid crystal capacitance Clc and the storage capacitance Cst.

TFTs 23A and 24A configuring the second switching device on the odd-numbered row are of a same conductive type, and respective gate electrodes 23Ag and 24Ag are connected to the neighboring gate lines G2 and G1 which are different from each other. Either the source electrode or the drain electrode of the TFT 23A is connected to the black signal supplying wiring VBK1, and the other electrode is connected either to the source electrode or the drain electrode of the TFT 24A. The other electrode (out of the source electrode and the drain electrode) of the TFT 24A is connected to the liquid crystal capacitance Clc and the storage capacitance Cst. The conductive types of the TFTs 21A, 22A configuring the first switching device and the TFTs 23A, 24A configuring the second switching device are different from each other, and the respective gate electrodes 21Ag, 23Ag of the TFTs 21A, 23A are connected to the same gate line G2.

Regarding each pixel on the second pixel row that is an even-numbered pixel row, TFTs 21B and 22B configuring the first switching device are of a same conductive type, and respective gate electrodes 21Bg and 22Bg are connected to the neighboring gate lines G3 and G2 which are different from each other. Either the source electrode or the drain electrode of the TFT 21B is connected to one of the data lines D1-D4, and the other electrode is connected either to the source electrode or the drain electrode of the TFT 22B. The other electrode (out of the source electrode and the drain electrode) of the TFT 22B is connected to the liquid crystal capacitance Clc and the storage capacitance Cst.

TFTs 23B and 24B configuring the second switching device on the even-numbered row are of a same conductive type, and respective gate electrodes 23Bg and 24Bg are connected to the neighboring gate lines G3 and G2 which are different from each other. Either the source electrode or the drain electrode of the TFT 23B is connected to the black signal supplying wiring VBK1, and the other electrode is connected either to the source electrode or the drain electrode of the TFT 24B. The other electrode (out of the source electrode and the drain electrode) of the TFT 24B is connected to the liquid crystal capacitance Clc and the storage capacitance Cst. The conductive types of the TFTs 21B, 22B configuring the first switching device and the TFTs 23B, 24B configuring the second switching device are different from each other, and the respective gate electrodes 21Bg, 23Bg of the TFTs 21B, 23B are connected to the same gate line G2.

The conductive types of the two each of the TFTS configuring the first and second switching devices are the same for each of the pixels both on the odd-numbered pixel rows and the even-numbered pixel rows, and the conductive types of the TFTs configuring the first switching device and the TFTs configuring the second switching device are different. Furthermore, the conductive types of the TFTs configuring the first switching device and the TFTs configuring the second switching devices are different for the pixels on the odd-numbered pixel row and the pixels on the even-numbered pixel row.

The structures of each pixel 50 on other pixel rows are the same as the structure of the pixel 50 shown in FIG. 15, except for the gate lines G1-G5 and data lines D1-D4 to be connected. Note that the structure shown in the drawing illustrate the case of a TN (Twisted Nematic) mode, a VA (Vertical Alignment) mode, and the like, so that the common electrodes COM are formed on the first substrate 11 as in the case of the first exemplary embodiment.

A gate driver circuit 46 is controlled at least by a start signal STD and a clock signal CLK, and has a function of outputting the start signal STD to each of the gate lines G1-G5 while sequentially shifting it by synchronizing with the clock signal. It is also possible to use a gate driver circuit 46 that has a function capable of changing the scanning direction with two start signals STD, STU, and a shift direction control signal DIR. FIG. 14 shows a case which uses the gate driver circuit 46 that has the function capable of changing the shift direction.

Figure 16:
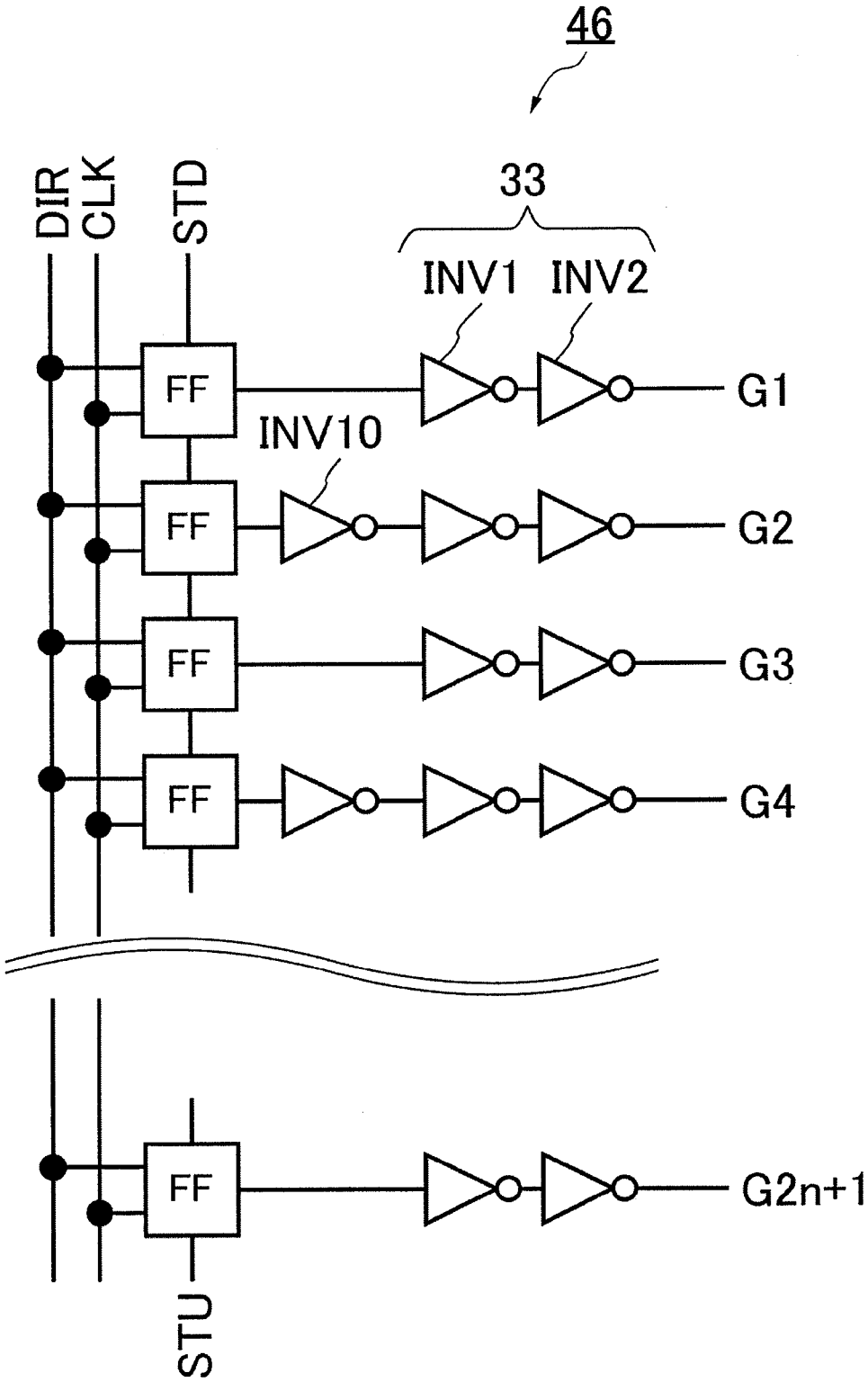
FIG. 16 is a block diagram showing an example of a gate driver circuit of FIG. 14.

As a structural example of the gate driver circuit 46 having such function, there is a circuit shown in FIG. 16. This gate driver circuit 46 basically has a same structure as that of the gate driver circuit shown in FIG. 8. However, there is a difference in respect that an inverter INV10 is inserted between the buffer circuit 33 and the flip-flop FF for driving the even-numbered gate line. The logics of the odd-numbered gate line and the even-numbered gate line are inverted by the inverter INV10. In the circuit shown in FIG. 16, the buffer circuit 33 may not be essential depending on the loads of the gate lines G1, - - - .

Next, a driving method of the liquid crystal display device according to the exemplary embodiment, i.e., operations of the liquid crystal display device according to the exemplary embodiment, will be described by mainly referring to a timing chart shown in FIG. 17.

Figure 17:
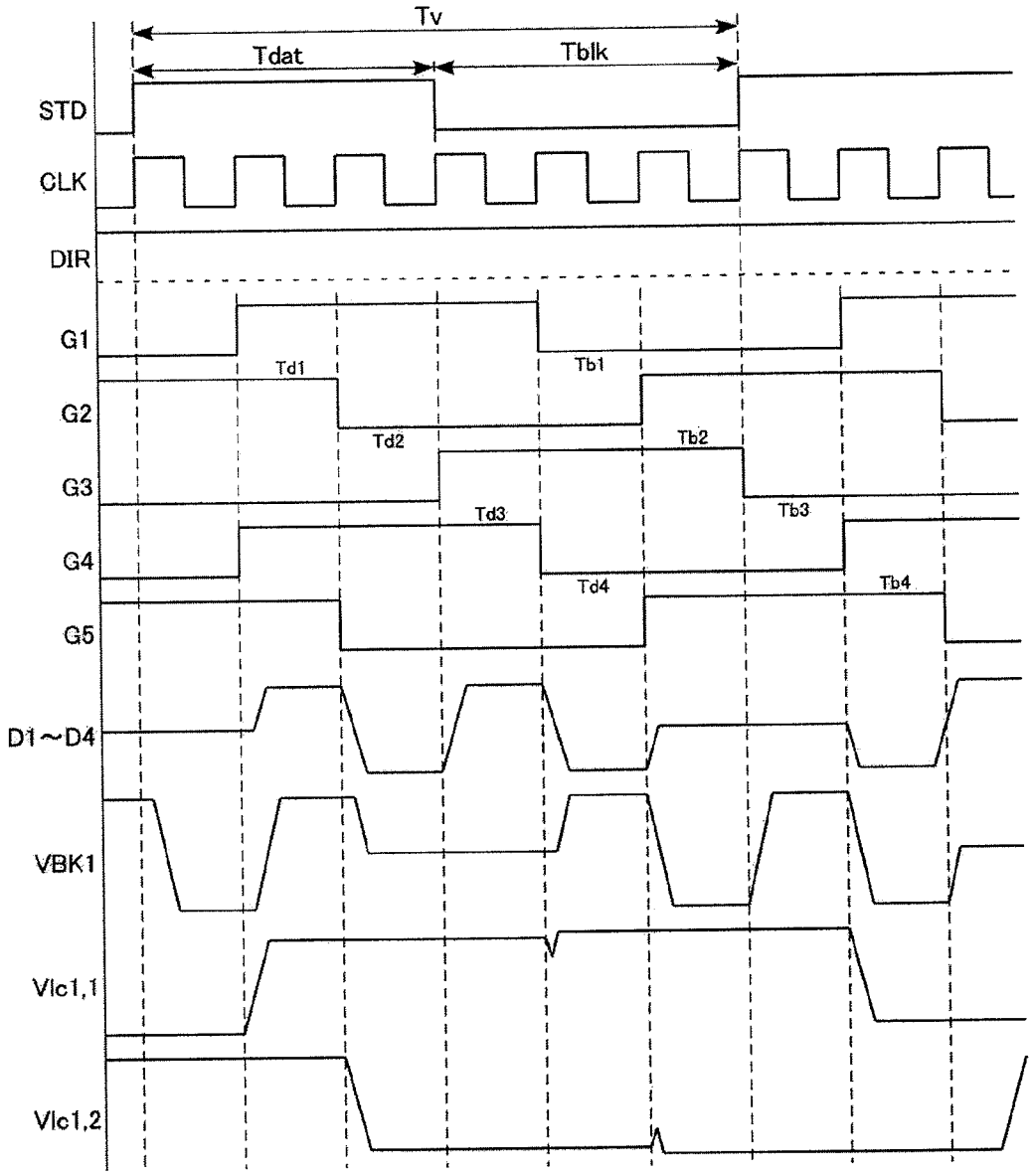
FIG. 17 is a timing chart showing operations of the liquid crystal display device shown in FIG. 14.

A period Tv in FIG. 17 indicates a frame period in which video signals for one frame are supplied from outside. The start signal STD of the gate driver circuit 46 is set to high level by synchronizing with the period Tv. Upon this, the start signal STD is transferred by being synchronized with the clock signal CLK, and outputted from each of the output terminals (gate lines G1, - - - ) of the gate driver circuit 46. Note, however, that the logic of the potential level of the even-numbered gate lines (G2, G4) is inverted.

First, operations of the odd-numbered pixel row will be described. In a period Td1 in FIG. 17, the gate line G1 becomes high level and the gate line G2 stays high level. Thus, at the pixels 50 between the gate line G1 and the gate line G2, the TFTs 21A and 22A both become electrically conductive, so that the video signals supplied to the data lines D1-D4 are written to the liquid crystal capacitances Clc and the storage capacitances Cst. At this time, the TFTs 23A and 24A are both in an open state.

In a period Td2 in FIG. 17, the gate line G1 stays high level, while the gate line G2 turns to low level. Thus, the TFT 22A comes to be in an electrically conductive state, while the TFT 21A comes to be in an open state. Therefore, the liquid crystal capacitances Clc and the storage capacitances Cst are electrically disconnected from the data lines D1-D4. At this time, the TFTs 23A come to be in an electrically conductive state, while the TFTs 24A are in an open state. Therefore, the liquid crystal capacitances Clc and the storage capacitances Cst remain as being electrically disconnected from the black signal supplying wiring VBK1, and the video signals written in the period Td1 are held at the pixels 50.

In the period Tv, the start signal STD is high level in a period Tdat. Thus, each of the odd-numbered outputs of the gate driver circuit 46 becomes high level for a same length of time as that of the period Tdat, and each of the even-numbered outputs of the gate driver circuit 46 becomes low level for a same length of time as that of the period Tdat.

Therefore, in the period Tb1 of FIG. 17, the gate line G1 changes to low level. At this time, the TFTs 21A and 22A are both in an open state at the pixels 50 on the pixel row between the gate line G1 and the gate line G2. However, the TFTs 23A and 24A both come to be in an electrically conductive state, so that the voltage of the black signal supplying wiring VBK1 is written to the liquid crystal capacitances Clc and the storage capacitances Cst.

In the period Tb2 of FIG. 17, the gate line G2 also change to high level. Thus, the TFTs 23A change to be in an open state, and the liquid crystal capacitances Clc and the storage capacitances Cst are electrically disconnected from the black signal supplying wiring VBK1. At this time, the TFTs 21A change to be in an electrically conductive state, while the TFTs 22A stay in an open state. Therefore, the liquid crystal capacitances Clc and the storage capacitances Cst are remained to be electrically disconnected from the data lines D1-D4. With this, the black signals written in the period Tb1 are held at the pixels 50.

Next, operations of the even-numbered pixel row will be described. In a period Td2, the gate line G2 changes to low level and the gate line G3 stays low level. Thus, the TFTs 21B and 22B both become electrically conductive, so that the video signals supplied to the data lines D1-D4 are written to the liquid crystal capacitances Clc and the storage capacitances Cst. At this time, the TFTs 23B and 24B both stay in an open state. In a next period Td3, the gate line G3 changes to high level. Thus, the TFTs 21B come to be in an open state, so that the liquid crystal capacitances Clc and the storage capacitances Cst remain to be electrically disconnected from the data lines D1-D4. At this time, the TFTs 24B are in an open state, while the TFTs 23B become electrically conductive. Therefore, the liquid crystal capacitances Clc and the storage capacitances Cst remain to be electrically disconnected from the black signal supplying wiring VBK1, and the video signals written in the period Td2 are held at the pixels 50.

In a period Tb2, the gate line G2 changes to high level, and the gate line G3 is high level. Thus, the TFTs 23B and 24B both become electrically conductive, so that the voltage of the black signal supplying wiring VBK1 is written to the liquid crystal capacitances Clc and the storage capacitances Cst. In a next period Tb3, the gate line G3 changes to low level. Thus, the TFTs 23B come to be in an open state, so that the liquid crystal capacitances Clc and the storage capacitances Cst are electrically disconnected from the black signal supplying wiring VBK1. At this time, the TFTs 22B remains to be in an open state, while the TFTs 21B change to be electrically conductive. Therefore, the liquid crystal capacitances Clc and the storage capacitances Cst remain to be electrically disconnected from the data lines D1-D4 as well. With this, the black signals written in the period Tb2 are held at the pixels 50.

Through performing such operations for all the pixel rows, the video signals and the black signals for one screen can be written in the pixel matrix 14, to all the pixels 50 sequentially by a row unit. The voltage Vlc1,1 in FIG. 17 shows the voltage of the pixel 50 connected to the data line D1, which is disposed between the gate line G1 and the gate line G2. Similarly, the voltage Vlc1,2 in FIG. 17 shows the voltage of the pixel 50 connected to the data line D1, which is disposed between the gate line G2 and the gate line G3.

Figure 18:
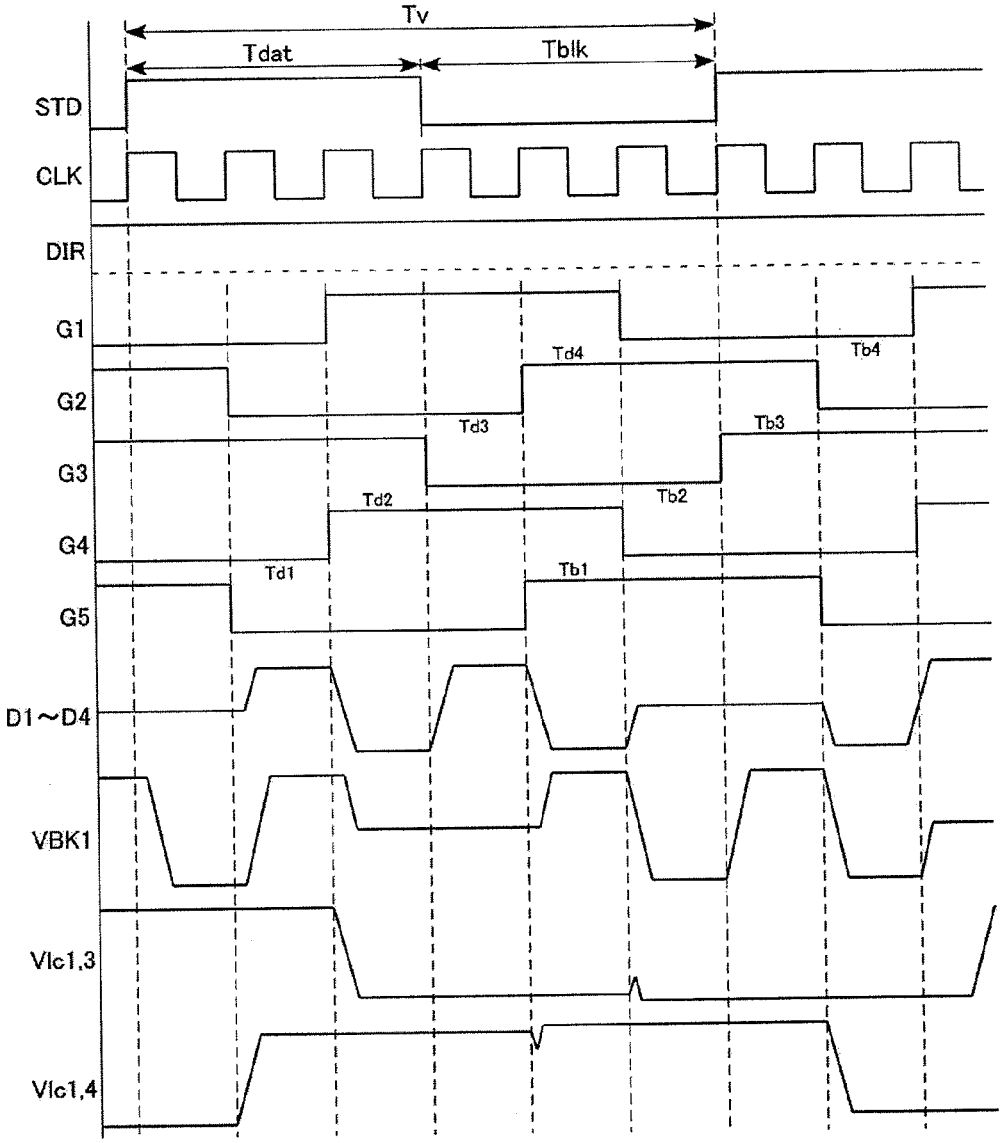
FIG. 18 is another timing chart showing operations of the liquid crystal display device shown in FIG. 14.

FIG. 18 shows operations when starting writing of the video signals from the pixel row of the gate line G5. In the period Tv of one frame in FIG. 18, the start signal STU of the gate driver circuit 46 is set to low level. Upon this, the start signal STU is transferred by being synchronized with the clock signal CLK, and outputted from each of the output terminals (gate lines G1, - - - ) of the gate driver circuit 46. Note, however, that the logic of the potential level of the even-numbered gate lines (G2, G4) is inverted. The operations for writing the video signals and the black signals to each pixel are the same as the case of writing the video signals from the pixel row of the gate line G1, so that detailed explanations thereof are omitted.

As has been described above, the liquid crystal display device according to the exemplary embodiment performs the operations to write the video signals to all the pixels 50 in one-frame period by a row unit to display the video signals for the length of the period Tdat, and then to write the black signals to all the pixels 50 by a row unit to display black for the length of the period Tblk.

Further, the period for displaying the video signals and the period for displaying the black signals can be changed with the time in which the start signals STD and STU of the gate driver circuit 46 are set to high level or low level. Furthermore, it is also possible to vertically invert the image displayed in the liquid crystal display device through changing the scanning direction of the gate driver circuit 46.

Further, the black signal supplying wiring VBK1 is common to all the pixels 50. Thus, it is possible to employ a method in which the polarities of the black signals written to each pixel 50 for the common electrode COM that is the other electrode configuring the liquid crystal capacitance Clc are set to be the same for each pixel row and set to be different for the pixel rows neighboring to each other vertically, and to employ a method in which the polarities of the black signals written to all the pixels 50 for the common electrodes COM are set to be the same in one-frame period. FIG. 17 and FIG. 18 illustrate an example of the method in which the polarities of the black signals for the common electrodes COM are set to be the same for each pixel row.

In the above, the exemplary embodiment has been described by referring to the case where the four pixels 50 each are arranged longitudinally and vertically. However, the number of pixels 50 has no influence upon the essential features of the present invention. Further, regarding the conductive types of the TFTs 21A-24A and the TFTs 21B-24B, it is possible to employ p-channel type TFTs 21A, 22A, 23B, 24B and n-channel type TFTs 23A, 24A, 21B, 22B. In that case, the logics of the gate driver circuit 46 may be inverted. The structure of the gate driver circuit 46 is not limited to the structure described above, as long as it has a function that is capable of transferring the start signals STD and STU sequentially by synchronizing with the clock signal CLK, and capable of having the logic levels of the odd-numbered output and the even-numbered output inverted.

With the liquid crystal display device of the exemplary embodiment, it is possible to achieve the quasi-impulse drive without increasing the cost of the liquid crystal display device. The reason is the same as the reason described in the first exemplary embodiment.

Third Exemplary Embodiment

Figure 19:
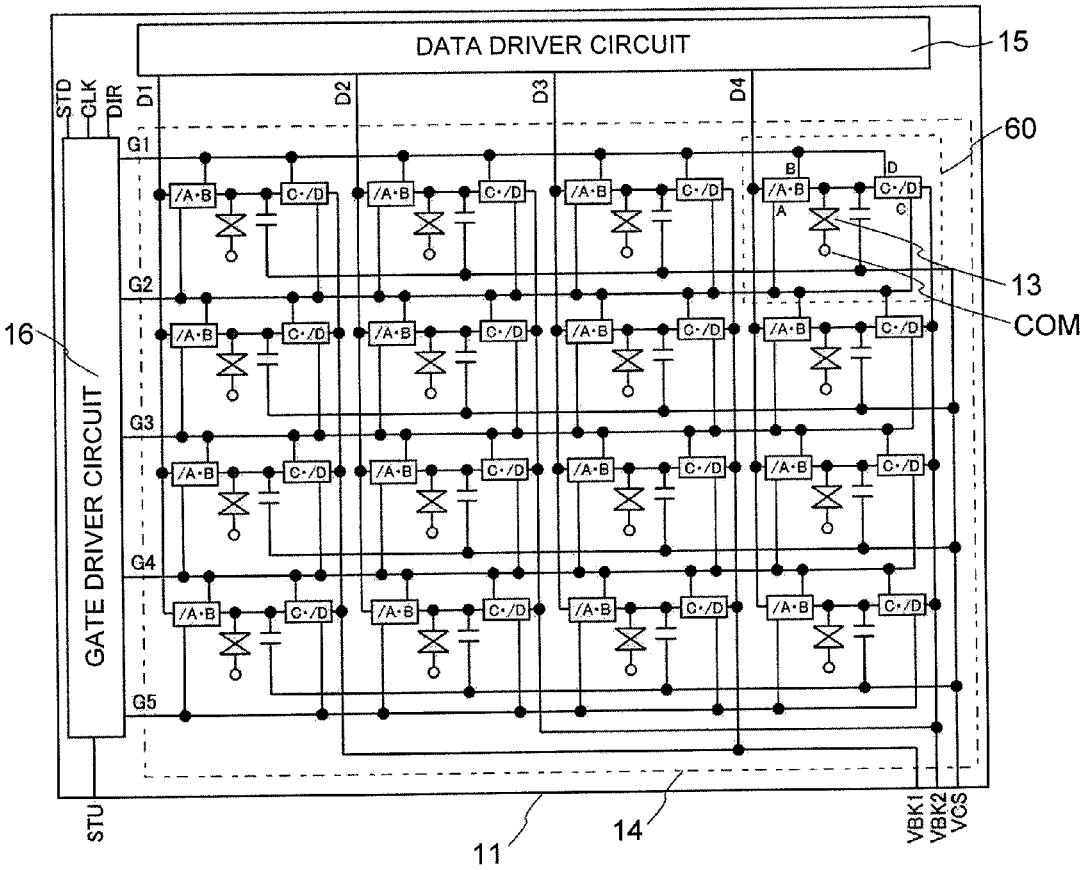
FIG. 19 is a block diagram and a circuit diagram showing a third exemplary embodiment of the liquid crystal display device according to the invention.
Figure 20:
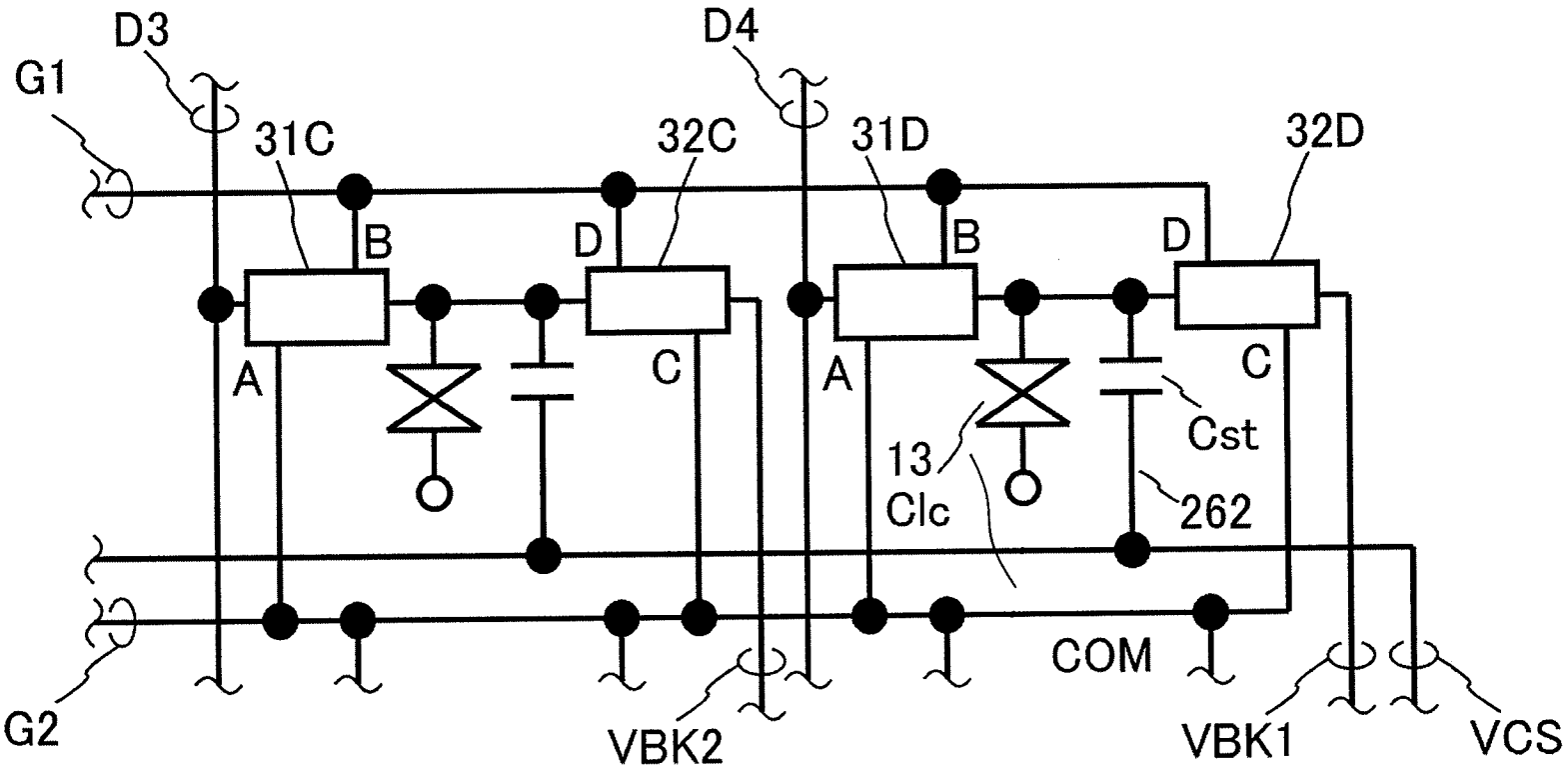
FIG. 20 is an enlarged circuit diagram showing two pixels taken out from FIG. 19.

FIG. 19 is a block diagram and a circuit diagram showing a third exemplary embodiment of the liquid crystal display device according to the present invention. FIG. 20 is an enlarged circuit diagram which shows two pixels 60 taken out from FIG. 19. Hereinafter, explanations will be provided by referring to FIG. 19 and FIG. 20. Same reference numerals are applied to the same components as those of FIG. 4, and detailed explanations thereof are omitted. Not only the pixels disposed between the gate lines G1, G2 and connected to the data lines D3, D4, but also all the other pixels are referred to as the pixels 60.

Differences between this exemplary embodiment with respect to the exemplary embodiment shown in FIG. 4 are that: there are two black signal supplying wirings VBK1 and VBK2 provided in the pixel matrix 14; and each of the pixels 60 can be classified into those connected to the black signal supplying wiring VBK1 and those connected to the black signal supplying wiring VBK2. That is, the black signal supplying wirings VBK1 and VBK2 are arranged alternately for each of the pixel rows that are neighboring to each other along the data lines D1-D4.

Figure 21:
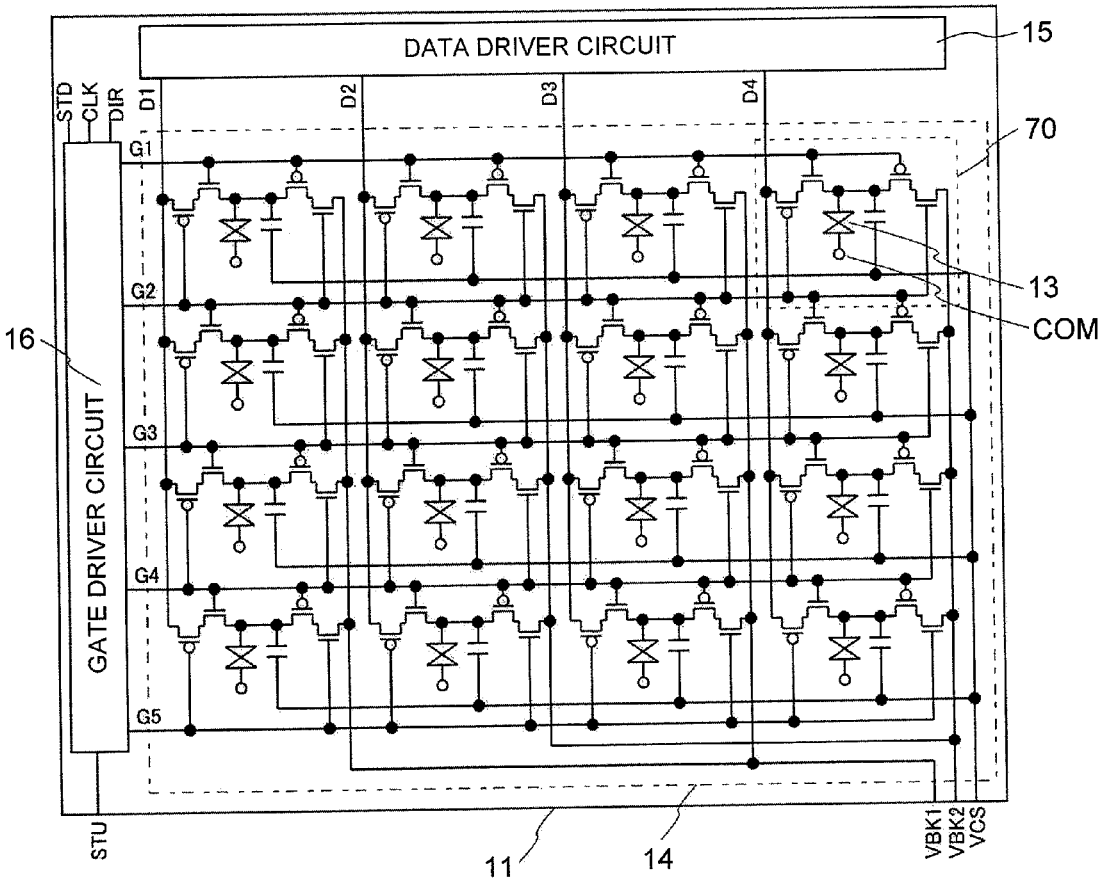
FIG. 21 is a detailed block diagram and a detailed circuit diagram showing the third exemplary embodiment of the liquid crystal display device according to the invention.

FIG. 21 shows a more specific structure of the third exemplary embodiment. This is a case where first switching devices 31C, 31D and second switching devices 32C, 32D for configuring each pixel shown in FIG. 20 are formed respectively with two TFTs of different conductive types.

Hereinafter, the liquid crystal display device according to this exemplary embodiment will be described in more detail. The structure of the liquid crystal display device according to this exemplary embodiment is almost the same as the structure of the liquid crystal display device shown in FIG. 4, except that there are two black signal supplying wirings VBK1 and VBK2. The two black signal supplying wirings VBK1 and VBK2 are arranged to be common for the pixels of the columns that are in parallel to the data lines D1-D4, and to be different for the neighboring pixel columns.

Figure 22:
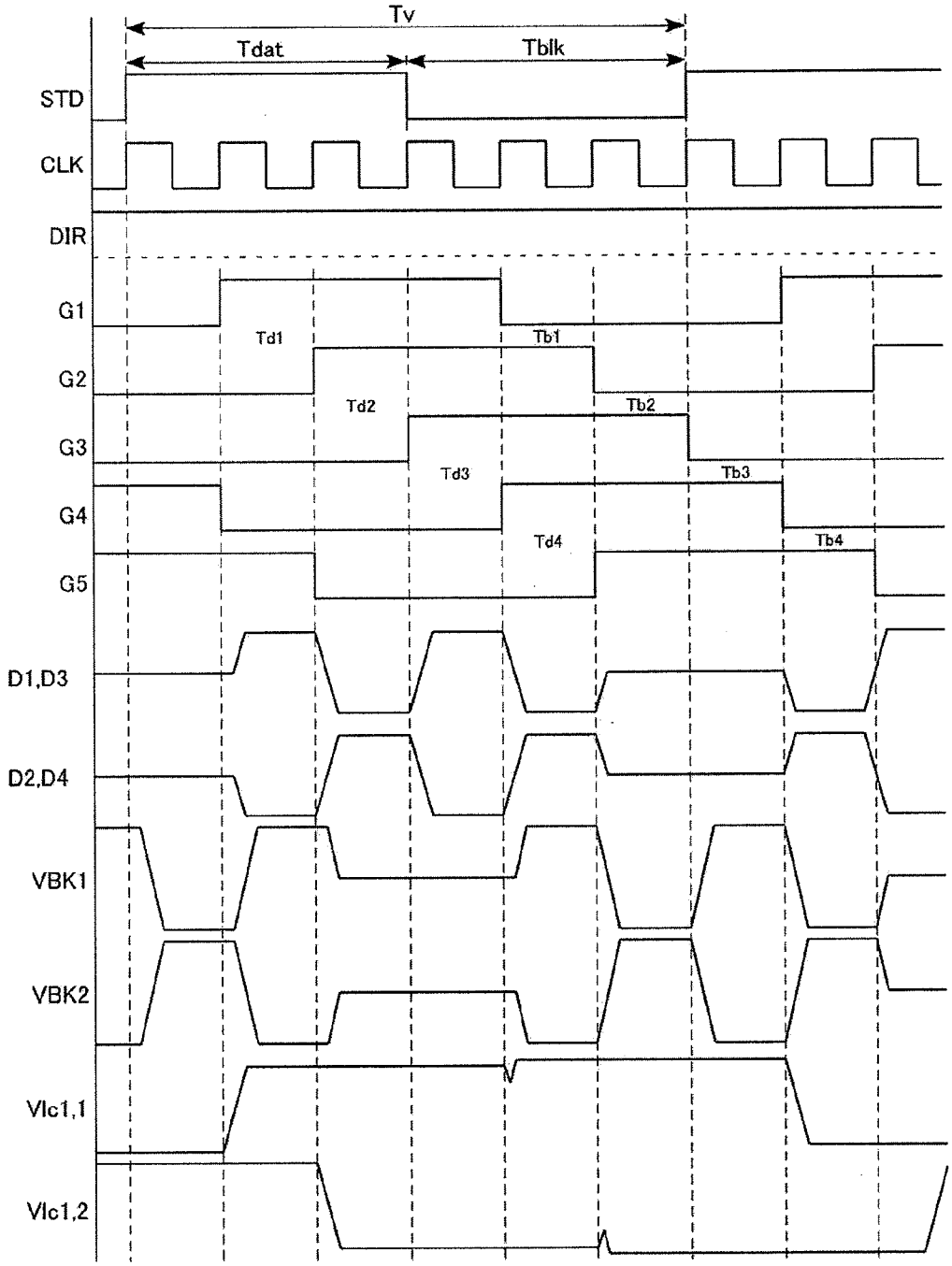
FIG. 22 is a timing chart showing operations of the liquid crystal display device shown in FIG. 21.

FIG. 22 is a timing chart showing operations of the liquid crystal display device according to the exemplary embodiment. The basic operations are the same as the operations of the liquid crystal display device of the first exemplary embodiment. The difference is that the polarities of the video signal and the black signal for the common electrodes COM are different by each pixel column. Therefore, in a specific period of one frame, the polarities of the video signals of the data lines D1 and D3 for the common electrodes COM are the same, the polarities of the video signals of the data lines D2 and D4 for the common electrodes COM are the same, and the polarities of the video signals of the data lines D1 and D2 for the common electrodes COM are different. Similarly, the polarities of the black signals in the black signal supplying wiring VBK1 and in the black signal supplying wiring VBK2 for the common electrodes COM are different. Thus, the polarities of the video signals and the black signals for the common electrodes COM are different for the pixels 60 that are disposed neighboring to each other vertically and laterally in the liquid crystal display device. The voltage Vlc1,1 in FIG. 22 shows the voltage of a pixel 70 connected to the data line D1, which is disposed between the gate line G1 and the gate line G2. Similarly, the voltage Vlc1,2 shows the voltage of the pixel 70 connected to the data line D1, which is disposed between the gate line G2 and the gate line G3.

The case described herein shows the operations when writing the video signals and the black signals to the liquid crystal display device sequentially from the pixel row connected to the gate line G1. However, like the relations of FIG. 10 and FIG. 11 used for describing the operations of the liquid crystal display device according to the first exemplary embodiment, it is also possible to achieve the operations for writing the video signals and the black signals from the pixel row connected to the gate line G5 through changing the start signals STD, STU, and the shift direction control signal DIR.

Further, other than the case presented herein, it is also possible to form the two TFTs configuring the first switching device and the second switching device by the same conductive-type TFTs, as in the case of the second exemplary embodiment. In that case, it is necessary to change the gate driver circuit 16 with the circuit shown in FIG. 16. Operations thereof are the same as those described in FIG. 17 and FIG. 18.

Next, effects of the liquid crystal display device according to this exemplary embodiment will be described.

With the liquid crystal display device of this exemplary embodiment, it is possible to improve the moving picture characteristic by achieving the quasi-impulse drive without deteriorating the luminance. The reason is the same as the reason described in the first exemplary embodiment.

Further, with the liquid crystal display device of this exemplary embodiment, it is possible to achieve the quasi-impulse drive without inducing a cost increase compared to the cases of the conventional liquid crystal display devices. The reasons are the same as the reasons described in the first exemplary embodiment.

Furthermore, with the liquid crystal display device of this exemplary embodiment, it becomes possible to adjust the luminance according to the displayed images. Thus, the power consumption can be decreased. The reason is the same as the reason described in the first exemplary embodiment.

Further, with the liquid crystal display device of the exemplary embodiment, it is possible to decrease flickers. The reason is that the polarities of the video signals for the common electrodes COM are different among the pixels 70 which are neighboring to each other vertically and laterally. In the liquid crystal display device, it is common to change the polarity of the video signal written to each pixel 70 for the common electrode COM by every frame period so that the DC (direct current) electric field is not continuously written to the liquid crystal. However, there are cases where a voltage error of the video signals written to the pixels 70 because of the polarities for the common electrodes COM may be changed due to a difference in field-through of the pixel TFTs, a difference in leak currents of the pixel TFTs, etc. In such cases, there is a difference generated in the luminance between a case where the polarity of the video signal for the common electrode COM is positive and a case where it is negative, thereby generating flickers. However, when the polarities of the video signals are different between the neighboring pixels 70, the luminance differences caused due to the voltage errors can be leveled. Therefore, it is possible to decrease the flickers. In the liquid crystal display device of the exemplary embodiment, the polarities of the video signals for the common electrodes COM are different among the pixels 70 which are neighboring to each other vertically and laterally. Therefore, the flickers can be reduced further.

Fourth Exemplary Embodiment

Figure 23:
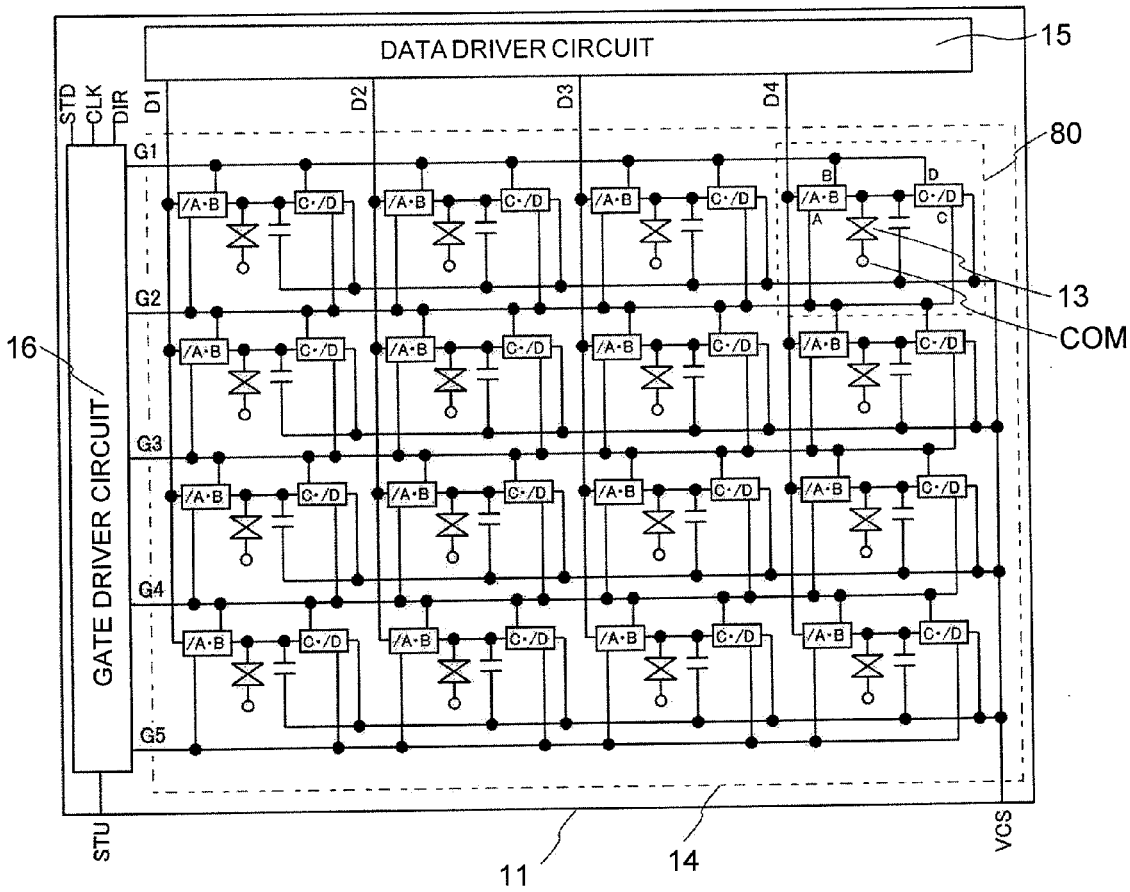
FIG. 23 is a block diagram and a circuit diagram showing a fourth exemplary embodiment of the liquid crystal display device according to the invention.
Figure 24:
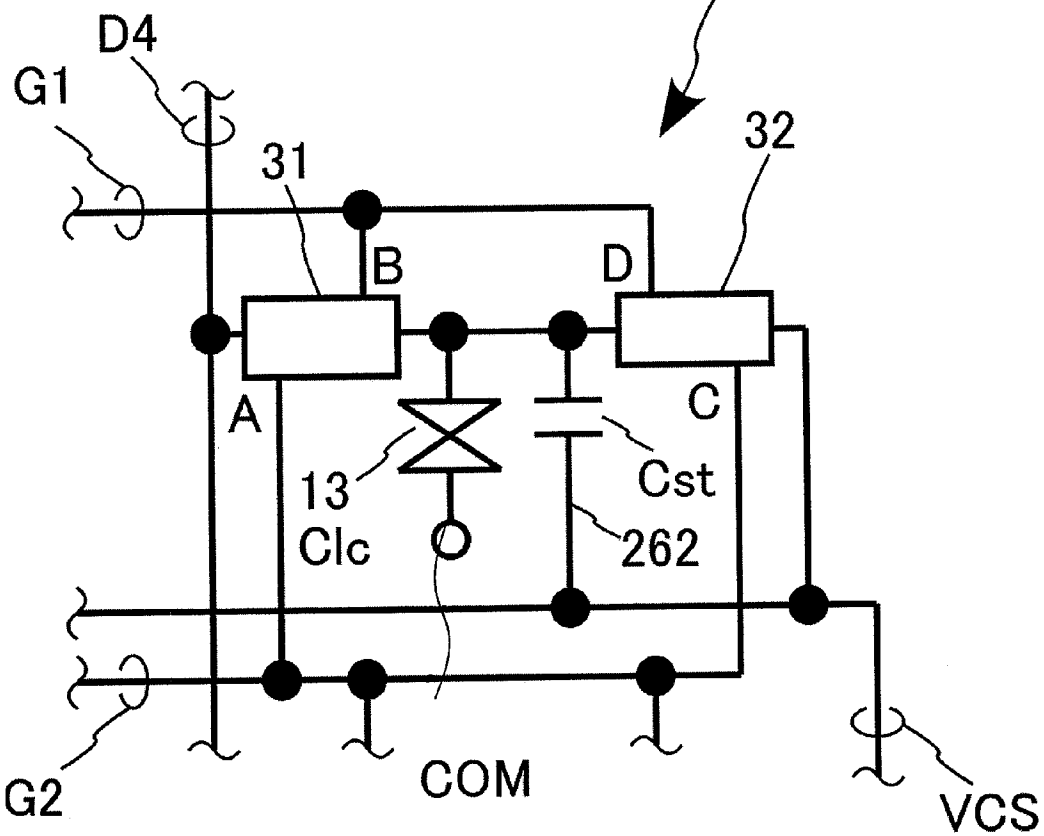
FIG. 24 is an enlarged circuit diagram showing a single pixel taken out from FIG. 23.

FIG. 23 is a block diagram and a circuit diagram showing a fourth exemplary embodiment of a liquid crystal display device according to the present invention. FIG. 24 is an enlarged circuit diagram showing a single pixel taken out from FIG. 23. Same reference numerals are applied to the same components as those of FIG. 4, and detailed explanations thereof are omitted. Not only the pixels disposed between the gate lines G1, G2 and connected to the data line D4, but also all the other pixels are referred to as pixels 80.

Differences between this exemplary embodiment with respect to the first exemplary embodiment are that: the black signal supplying wiring VBK1 (FIG. 4) is not provided in the pixel matrix 14; and the storage capacitance wiring VCS also functions as the black signal supplying wiring VBK1 (FIG. 4). That is, one of the two electrodes forming the storage capacitance Cst is connected to the first switching device 31 and the second switching device 32, and the other electrode is connected to a storage capacitance wiring VCS that is common to all the pixels 80. The alignment state of the liquid crystal according to this exemplary embodiment is controlled by the electric field generated between the two electrodes which form the pixel capacitance Clc. When there is no voltage applied to the pixel capacitance Clc, black is displayed. The potential of the storage capacitance wiring VCS is almost equivalent to the potential of the common electrode COM.

Figure 25:
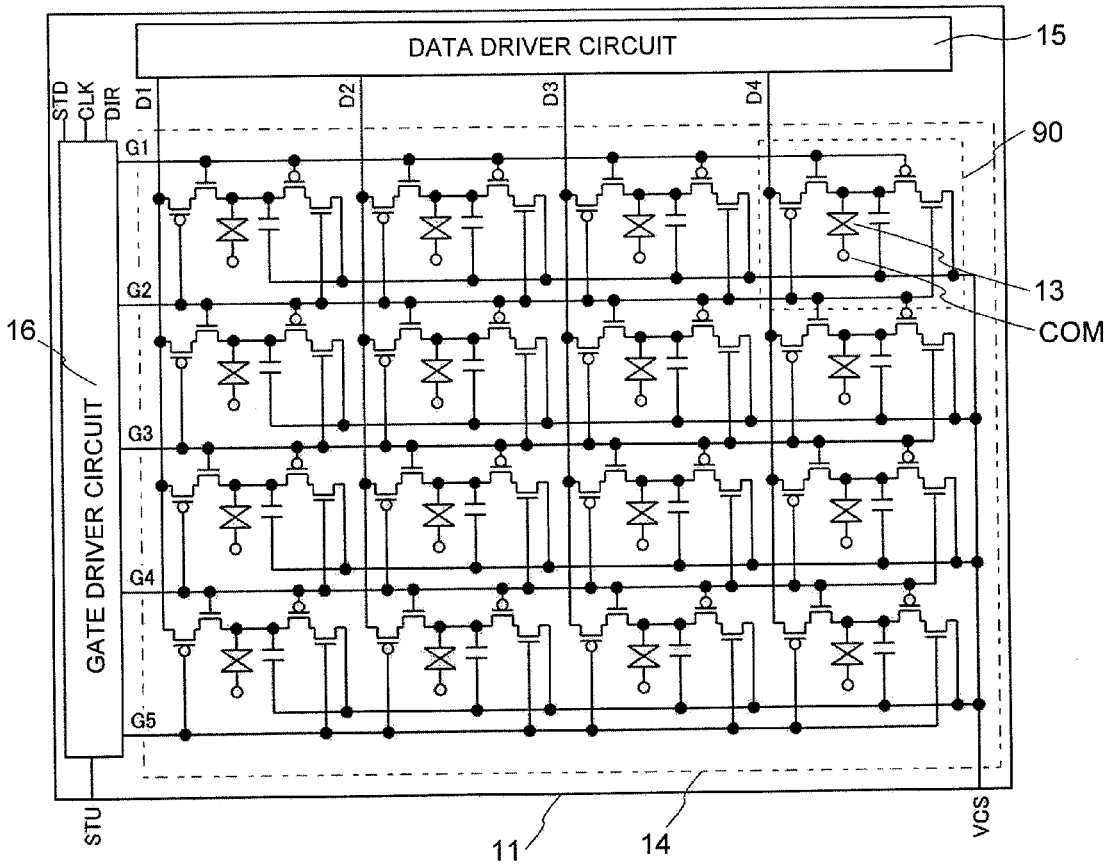
FIG. 25 is a detailed block diagram and a detailed circuit diagram showing the fourth exemplary embodiment of the liquid crystal display device according to the invention.

FIG. 25 shows a more specific structure of the fourth exemplary embodiment. This is a case where first switching devices 31C, 31D and second switching devices 32C, 32D for configuring each pixel shown in FIG. 24 are formed respectively with two TFTs of different conductive types.

Hereinafter, the liquid crystal display device according to this exemplary embodiment will be described in more detail. The structure of the liquid crystal display device according to this exemplary embodiment is almost the same as the structure of the liquid crystal display device of the first exemplary embodiment, except that the black signal supplying wirings VBK1 (FIG. 4) is not provided, and the TFT configuring the second switching device of each pixel 90 is connected to the storage capacitance wiring VCS instead. Further, the liquid crystal display device of the present invention employs the system such as a VA mode or an IPS mode which displays black when a voltage is not applied to the liquid crystal. Note here that a voltage that is almost equivalent to that of the common electrode COM is applied to the storage capacitance wiring VCS.

Figure 26:
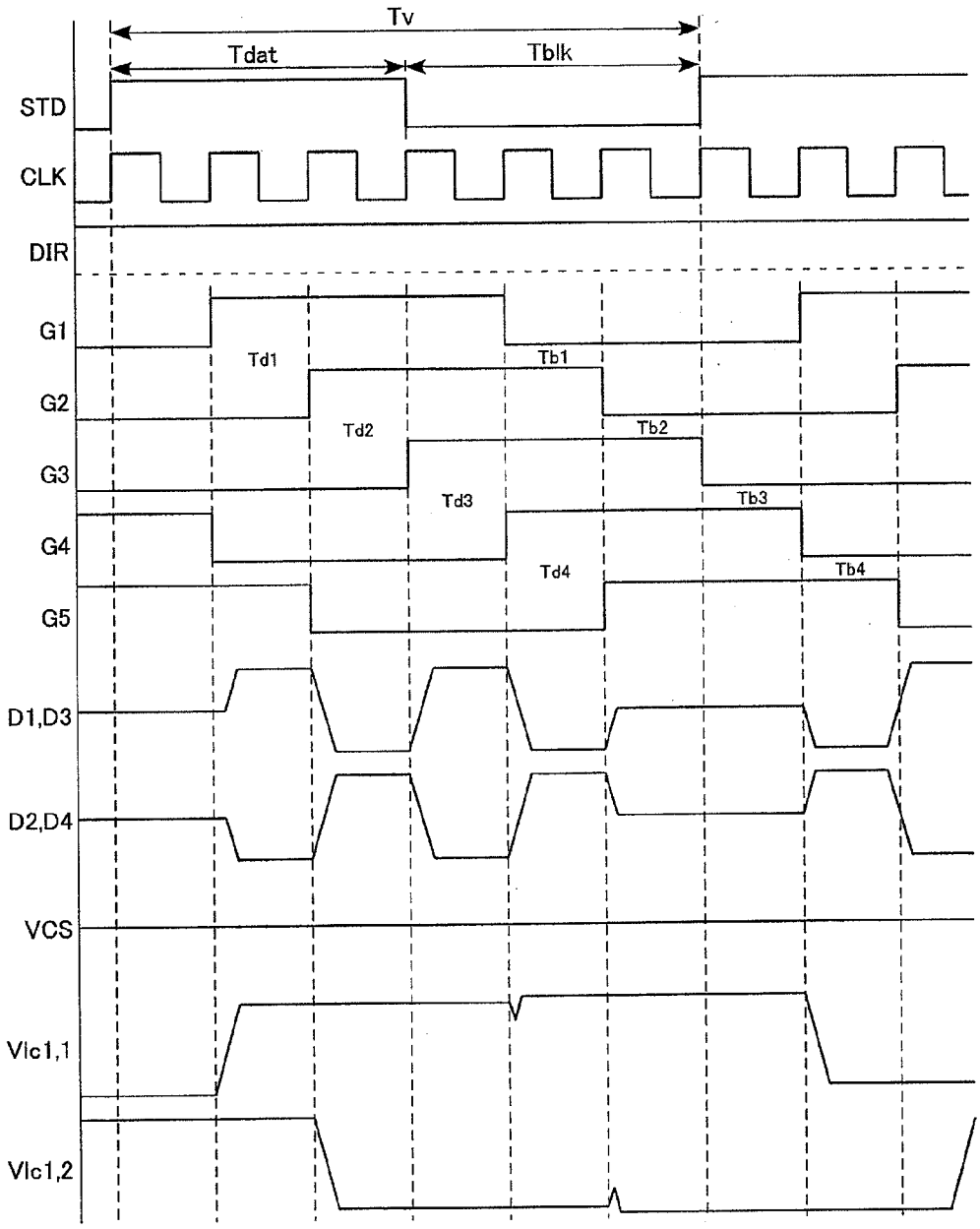
FIG. 26 is a timing chart showing operations of the liquid crystal display device shown in FIG. 25.
Figure 27:
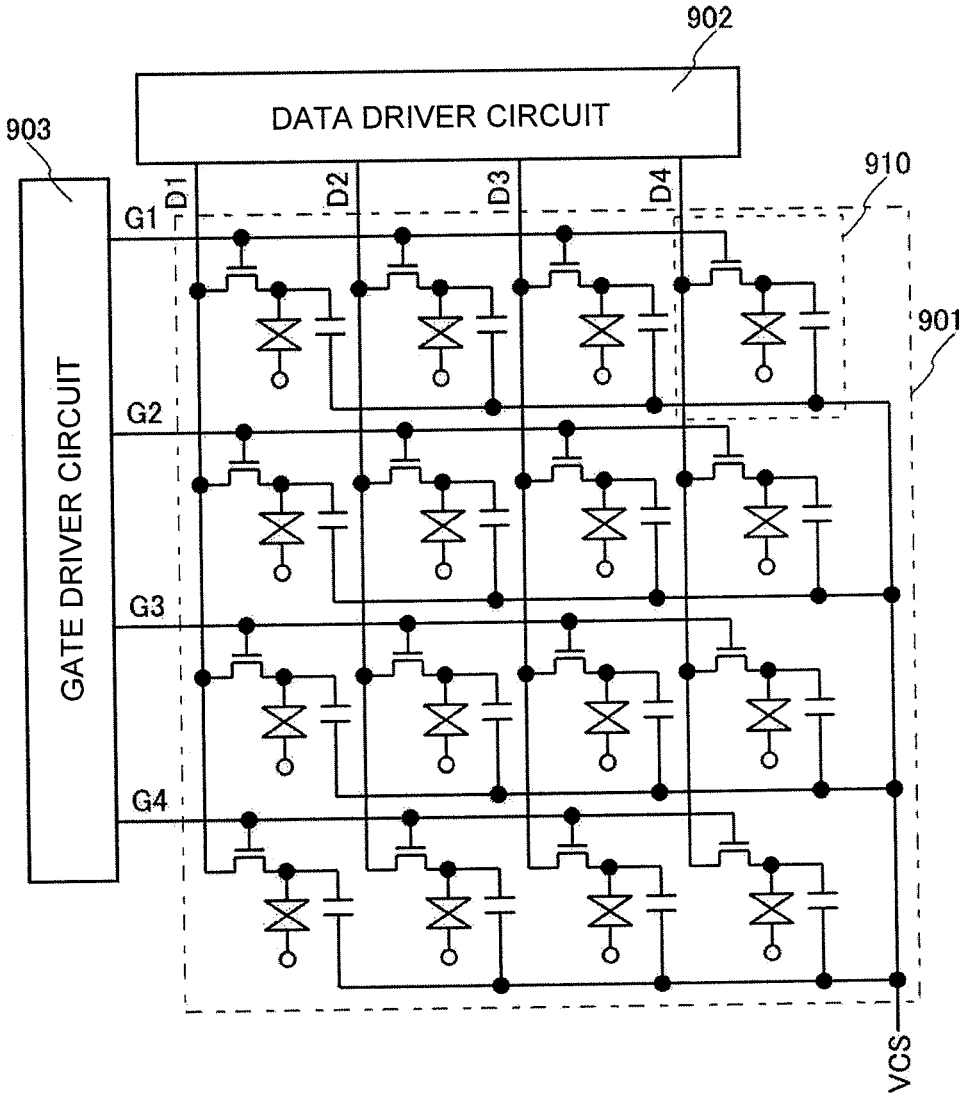
FIG. 27 is a block diagram and a circuit diagram showing a liquid crystal display device used for quasi-impulse drive.
Figure 28:
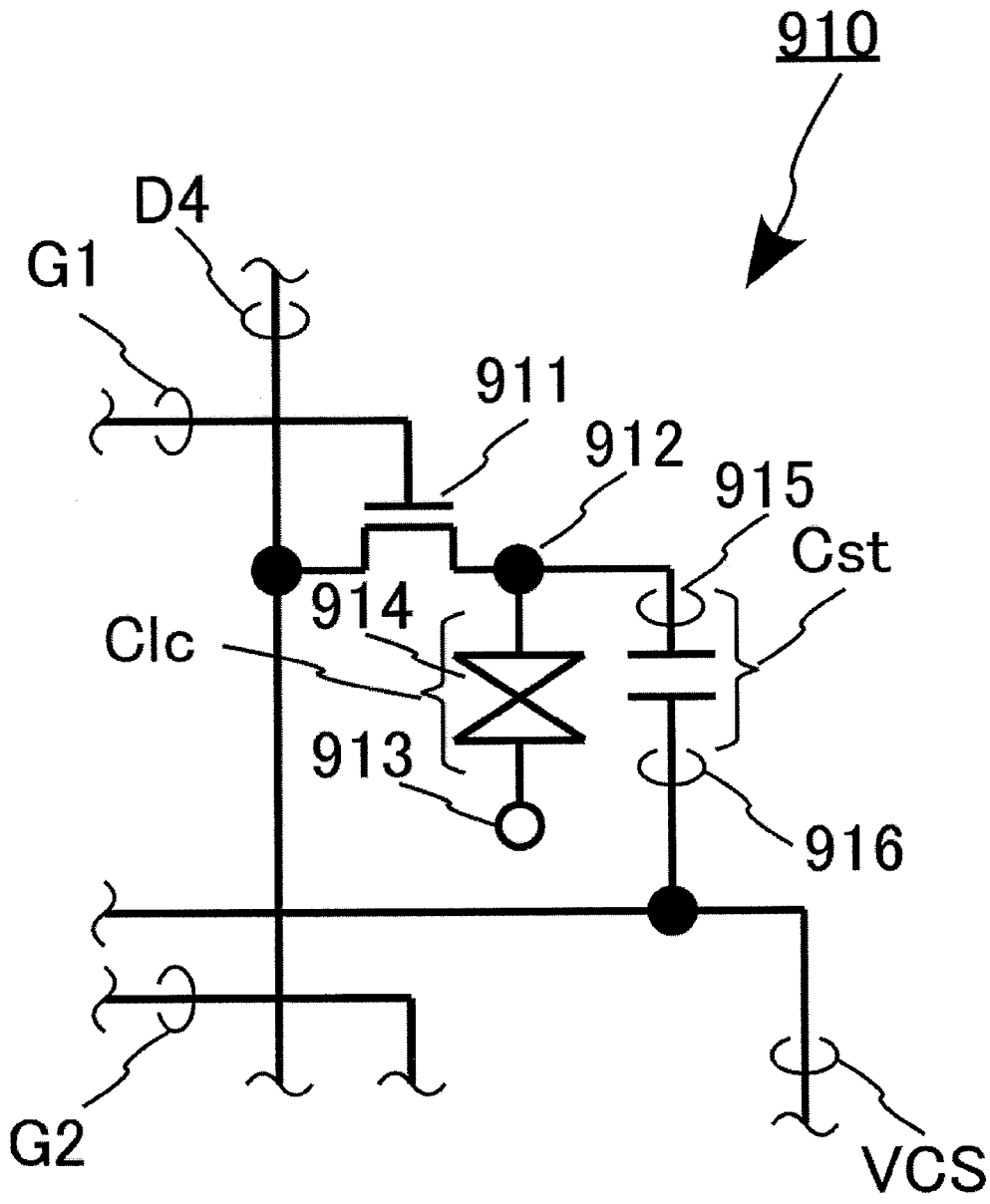
FIG. 28 is a an enlarged circuit diagram showing a single pixel taken out from FIG. 27.
Figure 29:
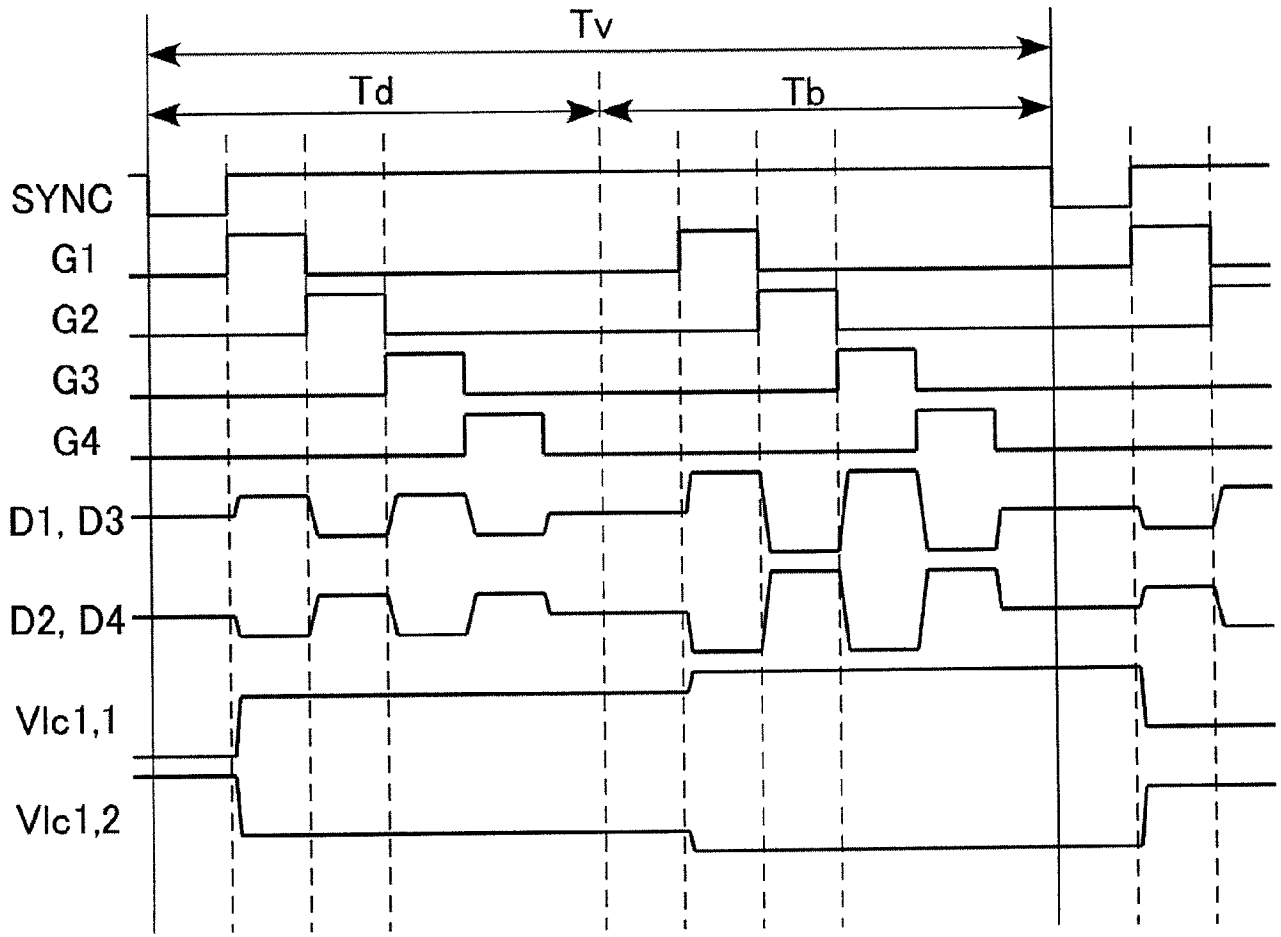
FIG. 29 is a timing chart showing operations of the liquid crystal display device of FIG. 27.

FIG. 26 is a timing chart showing operations of the liquid crystal display device according to this exemplary embodiment. The basic operations of the liquid crystal display device according to the fourth exemplary embodiment are the same as the operations of the liquid crystal display device according to the first exemplary embodiment. However, there are differences with respect to the operations of the liquid crystal display device according to the first exemplary embodiment in respect that the polarities of the video signals for the common electrodes COM are different for each pixel column and that the voltage of the storage capacitance wiring VCS is sequentially written to the pixels 90 instead of the black signals.

The voltage Vlc1,1 in FIG. 26 shows the voltage of the pixel 90 connected to the data line D1, which is disposed between the gate line G1 and the gate line G2. The voltage Vlc1,2 shows the voltage of the pixel 90 connected to the data line D1, which is disposed between the gate line G2 and the gate line G3. As can be seen from this, regarding the voltage Vlc1,1, the video signals are written in the period Td1. Thereafter, the written signals are continuously held. In the period Tb1, the voltage of the storage capacitance wiring VCS is written and held.

As described, it is the feature of the liquid crystal display device driving method of this exemplary embodiment to write the video signals to each pixel 90 from the data lines D1-D4 via the two TFTs configuring the first switching device, and then to write the voltage to each pixel 90 from the storage capacitance wiring VCS via the two TFTs configuring the second switching device with the same frequency as the frequency for writing the video signals, in a frame period where the video signals for one screen are supplied.

FIG. 26 shows the case of the driving method where the polarities of the video signals written to the pixels 90 which are neighboring to each other vertically and laterally with respect to the common electrodes COM are different. However, the present invention can be applied to any of the methods, i.e., a driving method where the polarities of the pixels 90 neighboring to each other vertically are different and the polarities of the pixels 90 neighboring to each other laterally are the same, a driving method where the polarities of the pixels 90 neighboring to each other vertically are the same and the polarities of the pixels 90 neighboring to each other laterally are different, and a driving method where the polarities are the same for all the pixels 90. In such cases, the polarities of the video signals supplied to the data lines D1-D4 may be changed depending on the driving methods.

The case described herein shows the operations when writing the video signals and the black signals to the liquid crystal display device sequentially from the pixel row connected to the gate lines G1. However, like the relations of FIG. 10 and FIG. 11 used for describing the operations of the liquid crystal display device according to the first exemplary embodiment, it is also possible to achieve the operations for writing the video signals and the black signals from the pixel row connected to the gate line 5 through changing the start signals STD, STU, and the shift direction control signal DIR.

Further, other than the case presented herein, it is also possible to form the two TFTs configuring the first switching device and the second switching device by the same conductive-type TFTs, as in the case of the second exemplary embodiment. In that case, it is necessary to change the gate driver circuit 16 with the circuit shown in FIG. 16. Operations thereof are the same as those described in FIG. 17 and FIG. 18.

Next, effects of the liquid crystal display device according to this exemplary embodiment will be described.

With the liquid crystal display device of the exemplary embodiment, it is possible to improve the moving picture characteristic by achieving the quasi-impulse drive without deteriorating the luminance. The reason is that it is possible with the liquid crystal display device of this exemplary embodiment to increase the numerical aperture than that of the liquid crystal display devices of the first and second exemplary embodiments, because it is unnecessary to provide the wirings (VBK1 and VBK2) used exclusively for supplying black signals to each pixel 90. As has been described above, the VA mode and the IPS mode are used with a normally black mode (a mode which displays black when there is no voltage applied to the liquid crystal). With the liquid crystal display device of this exemplary embodiment, it is possible to display black when writing the potential of the storage capacitance wiring VCS to the pixels 90, through setting the potential of the storage capacitance wiring VCS to be equivalent to that of the common electrodes COM. Therefore, it becomes unnecessary to provide the black signal supplying wiring to be used exclusively by connecting one of the pixel TFTs to the storage capacitance wiring VCS. As a result, the numerical aperture can be increased.

Further, with the liquid crystal display device of this exemplary embodiment, it is possible to achieve the quasi-impulse drive without inducing a cost increase compared to the cases of the conventional liquid crystal display devices. The reasons are the same as the reasons described in the first exemplary embodiment.

Furthermore, with the liquid crystal display device of the exemplary embodiment, it becomes possible to adjust the luminance according to the displayed images. Thus, the power consumption can be decreased. The reason is the same as the reason described in the first exemplary embodiment.

Further, with the liquid crystal display device of the exemplary embodiment, it is possible to decrease the flickers. The reason is the same as the reason described in the second exemplary embodiment.

(Others)

While the present invention has been described above by referring to each of the exemplary embodiments, the present invention is not limited to those exemplary embodiments. Various changes and modifications that occur to those skilled in the art may be applied to the structures and details of the present invention. Further, it is to be understood that the present invention includes combinations of a part of or the whole part of the structures described in each of the exemplary embodiments.

INDUSTRIAL APPLICABILITY

As described above, with the present invention, it is possible to achieve the bright liquid crystal display device at a low cost, which has no blurring generated in the contours of images even when moving pictures are displayed. Therefore, the present invention can be widely used in industrial fields that use the liquid crystal display devices such as TV sets, videos, portable terminals, and projectors, which means that the present invention exhibits a high industrial applicability.

What is claimed is:

1. A liquid crystal display device formed in a structure in which a liquid crystal is sandwiched between a first substrate and a second substrate, the first substrate including a plurality of pixels arranged in each area sectioned by a plurality of data lines and a plurality of gate lines, each of the pixels having a first switching device, a second switching device, a pixel capacitance, and a storage capacitance, wherein:

the pixel capacitance and the storage capacitance are connected to the data line via the first switching device;

the pixel capacitance and the storage capacitance are connected to a black signal supplying wiring via the second switching device;

the first switching device is controlled by two of the gate lines that are different from each other;

the second switching device is controlled by the two different gate lines;

the two different gate lines have consecutive four periods constituting one frame period, including two periods in which potential levels of the two gate lines are same with respect to each other and two periods in which the potential levels are different from each other;

the first switching device becomes electrically conductive in one of the four periods; and the second switching device becomes electrically conductive in one of the four periods, which is different from the period where the first switching device becomes electrically conductive, one of the two periods within the one frame period for which the potential levels are different from each other is equal to a period during which a video signal supplied by the data line is written to the liquid crystal display device, and the other one of the two periods within the one frame period for which the potential levels are different from each other is equal to a period during which a black signal supplied by the black signal supplying wiring is written to the liquid crystal display device.

2. The liquid crystal display device as claimed in claim 1, wherein:

the first and the second switching devices are respectively configured with two transistors of different conductive types which are connected in series;

the two transistors each configuring the first and the second switching devices are separately controlled by respective gate lines out of the two different gate lines; and in the two periods where the potential levels of the two different gate lines are different from each other, the first switching device becomes electrically conductive in one of the periods, and the second switching device becomes electrically conductive in the other period.

3. The liquid crystal display device as claimed in claim 1, wherein:

the first switching device is configured with two serially connected transistors of a same conductive type;

the second switching device is configured with two serially connected transistors of a conductive type that is different from the conductive type of the transistors of the first switching device;

the two transistors each configuring the first and the second switching devices are separately controlled by respective gate lines out of the two different gate lines; and in the two periods where the potential levels of the two different gate lines are same with respect to each other, the first switching device becomes electrically conductive in one of the periods, and the second switching device becomes electrically conductive in the other period.

4. The liquid crystal display device as claimed in any one of claims 1-3, wherein the black signal supplying wiring is common to all the pixels.

5. The liquid crystal display device as claimed in claim 4, wherein:

out of two electrodes forming the storage capacitance, one of the electrodes is connected to the second switching device, and the other electrode is connected to a storage capacitance wiring that is common to all the pixels; and the storage capacitance wiring also functions as the black signal supplying wiring.

6. The liquid crystal display device as claimed in claim 5, wherein:

an alignment state of the liquid crystal is controlled by an electric field generated by a pixel electrode and a common electrode;

black is displayed when no electric field is applied to the liquid crystal; and a potential of the storage capacitance wiring is almost equivalent to a potential of the common electrode.

7. The liquid crystal display device as claimed in any one of claims 1-3, comprising a plurality of the black signal supplying wirings, wherein each of pixel rows neighboring to each other along the data lines is connected to a different wiring of the black signal supplying wirings.

8. A liquid crystal display device driving method for driving a liquid crystal display device formed in a structure in which a liquid crystal is sandwiched between a first substrate and a second substrate, the first substrate including a plurality of pixels arranged in each area sectioned by a plurality of data lines and a plurality of gate lines, each of the pixels having a first switching device, a second switching device, a pixel capacitance, and a storage capacitance, wherein:

the pixel capacitance and the storage capacitance are connected to the data line via the first switching device;

the pixel capacitance and the storage capacitance are connected to a black signal supplying wiring via the second switching device;

the first switching device is controlled by two of the gate lines that are different from each other; and the second switching device is controlled by the two different gate lines, the two different gate lines have consecutive four periods constituting one frame period, including two periods in which potential levels of the two gate lines are same with respect to each other and two periods in which the potential levels are different from each other;

the first switching device becomes electrically conductive in one of the four periods; and the second switching device becomes electrically conductive in one of the four periods, which is different from the period where the first switching device becomes electrically conductive, the method comprising, in a frame period where video signals for one screen are supplied to the liquid crystal display device:

writing the video signals to each of the pixels from the data lines via the first switching devices; and then writing black signals to each of the pixels from the black signal supplying wiring via the second switching device with a frequency that is a same frequency for writing the video signals, wherein one of the two periods within the one frame period for which the potential levels are different from each other is equal to a period during which a video signal supplied by the data line is written to the liquid crystal display device, and the other one of the two periods within the one frame period for which the potential levels are different from each other is equal to a period during which a black signal supplied by the black signal supplying wiring is written to the liquid crystal display device.

9. A liquid crystal display device driving method for driving a liquid crystal display device formed in a structure in which a liquid crystal is sandwiched between a first substrate and a second substrate, the first substrate including a plurality of pixels arranged in each area sectioned by a plurality of data lines and a plurality of gate lines, each of the pixels having a first switching device, a second switching device, a pixel capacitance, and a storage capacitance, wherein:

the pixel capacitance and the storage capacitance are connected to the data line via the first switching device:

the pixel capacitance and the storage capacitance are connected to a storage capacitance wiring that is common to all the pixels via the second switching device;

the first switching device is controlled by two of the gate lines that are different from each other; and the second switching device is controlled by the two different gate lines, the two different gate lines have consecutive four periods constituting enone frame period, including two periods in which potential levels of the two gate lines are same with respect to each other and two periods in which the potential levels are different from each other;

the first switching device becomes electrically conductive in one of the four periods;

the second switching device becomes electrically conductive in one of the four periods, which is different from the period where the first switching device becomes electrically conductive;

out of two electrodes forming the storage capacitance, one of the electrodes is connected to the first switching device and the second switching device, and the other electrode is connected to the storage capacitance wiring, the method comprising, in a frame period where video signals for one screen are supplied to the liquid crystal display device:

writing the video signals to each of the pixels from the data lines via the first switching devices; and then writing a voltage of the storage capacitance wiring to each of the pixels from the storage capacitance wiring via the second switching device with a frequency that is a same frequency for writing the video signals, wherein the voltage of the storage capacitance wiring is same as a voltage that makes the liquid crystal display black, one of the two periods within the one frame period for which the potential levels are different from each other is equal to a period during which a video signal supplied by the data line is written to the liquid crystal display device, and the other one of the two periods within the one frame period for which the potential levels are different from each other is equal to a period during which a black signal supplied by the storage capacitance wiring is written to the liquid crystal display device.

10. A liquid crystal display device formed in a structure in which a liquid crystal is sandwiched between a first substrate and a second substrate, the first substrate including a plurality of pixels arranged in each area sectioned by a plurality of data lines and a plurality of gate lines, each of the pixels having a first switching device including a first transistor and a second transistor, a second switching device including a third transistor and a fourth transistor, a pixel capacitance, and a storage capacitance, wherein:

the pixel capacitance and the storage capacitance are connected to the data line via the first switching device;

the pixel capacitance and the storage capacitance are connected to a black signal supplying wiring via the second switching device;

the first switching device is controlled by two of the gate lines that are different from each other;

the second switching device is controlled by the two different gate lines;

the first transistor and the second transistor are of different conductive types from each other, and respective gate electrodes are connected to the neighboring gate lines which are different from each other, one of a source electrode and a drain electrode of the first transistor is connected to one of the data lines, the other electrode is connected to one of a source electrode and a drain electrode of the second transistor, and the other one of the source electrode and the drain electrode of the second transistor is connected to the pixel electrode and the storage capacitance, the third transistor and the fourth transistor are of different conductive types from each other, and respective gate electrodes are connected to the neighboring gate lines which are different from each other, and one of a source electrode and a drain electrode of the third transistor is connected to the black signal supplying wiring, the other electrode is connected to one of a source electrode and a drain electrode of the fourth transistor, and the other one of the source electrode and the drain electrode of the fourth transistor is connected to the pixel electrode and the storage capacitance, the first transistor and the fourth transistor are of a same conductive type with respect to each other, and the respective gate electrodes of the first transistor and the third transistor are connected to the same gate line.

11. A liquid crystal display device formed in a structure in which a liquid crystal is sandwiched between a first substrate and a second substrate, the first substrate including a plurality of pixels arranged in each area sectioned by a plurality of data lines and a plurality of gate lines, each of the pixels having a first switching device including a first transistor and a second transistor, a second switching device including a third transistor and a fourth transistor, a pixel capacitance, and a storage capacitance, wherein:

the pixel capacitance and the storage capacitance are connected to the data line via the first switching device;

the pixel capacitance and the storage capacitance are connected to a black signal supplying wiring via the second switching device;

the first switching device is controlled by two of the gate lines that are different from each other;

the second switching device is controlled by the two different gate lines;

the first transistor and the second transistor are of a same conductive type with respect to each other, and respective gate electrodes are connected to the neighboring gate lines which are different from each other, one of a source electrode and a drain electrode of the first transistor is connected to one of the data lines, the other electrode is connected to one of a source electrode and a drain electrode of the second transistor, and the other one of the source electrode and the drain electrode of the second transistor is connected to the pixel electrode and the storage capacitance, the third transistor and the fourth transistor are of a same conductive type with respect to each other, and respective gate electrodes are connected to the neighboring gate lines which are different from each other, and one of a source electrode and a drain electrode of the third transistor is connected to the black signal supplying wiring, the other electrode is connected to one of a source electrode and a drain electrode of the fourth transistor, and the other one of the source electrode and the drain electrode of the fourth transistor is connected to the pixel electrode and the storage capacitance, the first transistor and the fourth transistor are of different conductive types from each other, and the respective gate electrodes of the first transistor and the third transistor are connected to the same gate line.

* * * * *